US009257735B2

(12) United States Patent
Fakharzadeh et al.

(10) Patent No.: US 9,257,735 B2
(45) Date of Patent: Feb. 9, 2016

(54) RECONFIGURABLE WAVEGUIDE INTERFACE ASSEMBLY FOR TRANSMIT AND RECEIVE ORIENTATIONS

(71) Applicants: Mohammad Fakharzadeh, Toronto (CA); Mihai Tazlauanu, Markham (CA); Bradley R. Lynch, Toronto (CA); Behzad Biglarbegian, Toronto (CA)

(72) Inventors: Mohammad Fakharzadeh, Toronto (CA); Mihai Tazlauanu, Markham (CA); Bradley R. Lynch, Toronto (CA); Behzad Biglarbegian, Toronto (CA)

(73) Assignee: Peraso Technologies Inc., Toronto (CA)

( * ) Notice: Subject to any disclaimer, the term of this patent is extended or adjusted under 35 U.S.C. 154(b) by 414 days.

(21) Appl. No.: 13/870,465

(22) Filed: Apr. 25, 2013

(65) Prior Publication Data

US 2014/0285383 A1 Sep. 25, 2014

Related U.S. Application Data

(60) Provisional application No. 61/804,436, filed on Mar. 22, 2013.

(51) Int. Cl.

| | |
|---|---|
| ***H01P 5/08*** | (2006.01) |
| ***H01P 11/00*** | (2006.01) |
| ***H01P 5/107*** | (2006.01) |
| ***H01Q 21/00*** | (2006.01) |
| ***H01Q 13/02*** | (2006.01) |

(52) U.S. Cl.

CPC *H01P 5/08* (2013.01); *H01P 5/107* (2013.01); *H01P 11/00* (2013.01); *H01P 11/001* (2013.01); *H01Q 13/02* (2013.01); *H01Q 21/0075* (2013.01); *Y10T 29/49016* (2015.01)

(58) Field of Classification Search

CPC ... H01Q 13/00; H01Q 13/02; H01Q 21/0075; H01P 5/08; H01P 5/107; H01P 11/00; H01P 11/001

USPC ..... 333/26, 33

See application file for complete search history.

(56) References Cited

U.S. PATENT DOCUMENTS

| | | | | |
|---|---|---|---|---|
| 4,453,142 | A | 6/1984 | Murphy | |
| 5,796,371 | A | 8/1998 | Sato et al. | |
| 6,707,348 | B2 * | 3/2004 | Ammar | 333/26 |
| 2004/0036550 | A1 * | 2/2004 | Emrick et al. | 333/26 |

(Continued)

OTHER PUBLICATIONS

Non-Final Office Action mailed Aug. 28, 2015 for U.S. Appl. No. 13/870,457, 31 pages.

(Continued)

*Primary Examiner* — Robert Karacsony
*Assistant Examiner* — Daniel J Munoz

(57) ABSTRACT

An antenna apparatus comprises a lower assembly and an upper assembly, which together forming a cavity to contain an RF circuit device. The upper assembly comprises a waveguide flange interface at an external surface of the upper assembly. The waveguide flange interface comprises a waveguide channel extending from the external surface to an internal surface forming a surface of the cavity. An opening of the waveguide channel at the internal surface is substantially centered about a first centerline of the upper assembly parallel with the external surface and offset from a second centerline of the upper assembly parallel with the external surface, whereby the second centerline perpendicular is to the first centerline. The upper assembly is removably attachable to the lower assembly in either of a first orientation or a second orientation, whereby the second orientation represents a 180 degree rotation of the upper assembly relative to the first orientation.

19 Claims, 12 Drawing Sheets

(56) References Cited

U.S. PATENT DOCUMENTS

| | | | | |
|---|---|---|---|---|
| 2005/0270247 | A1* | 12/2005 | Kitamori et al. | 343/754 |
| 2009/0251375 | A1* | 10/2009 | Margomenos | 343/786 |
| 2011/0140799 | A1* | 6/2011 | Biran et al. | 333/26 |
| 2011/0156844 | A1 | 6/2011 | Wakabayashi et al. | |
| 2012/0176285 | A1* | 7/2012 | Morgia | 343/772 |
| 2014/0285389 | A1 | 9/2014 | Fakharzadeh et al. | |
| 2014/0285393 | A1 | 9/2014 | Biglarbegian et al. | |

OTHER PUBLICATIONS

Notice of Allowance mailed Jul. 8, 2015 for U.S. Appl. No. 13/870,472, 27 pages.

* cited by examiner

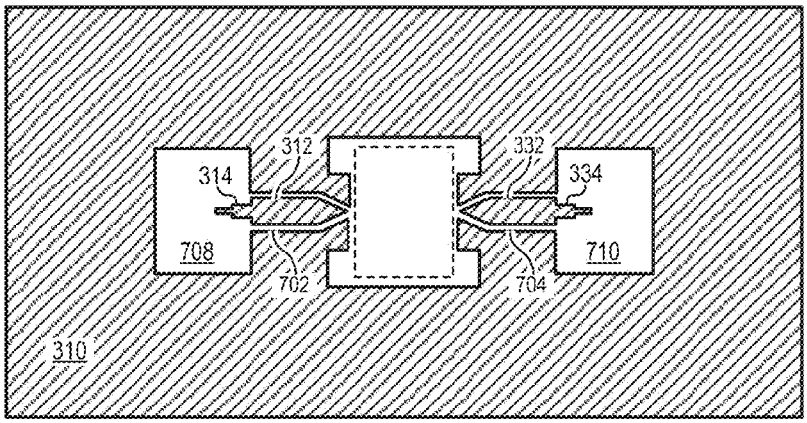
FIG. 7
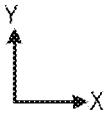
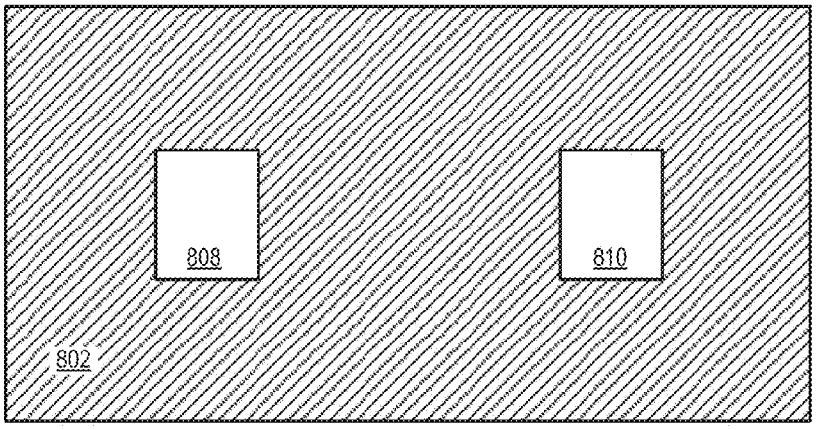
FIG. 8
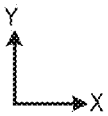
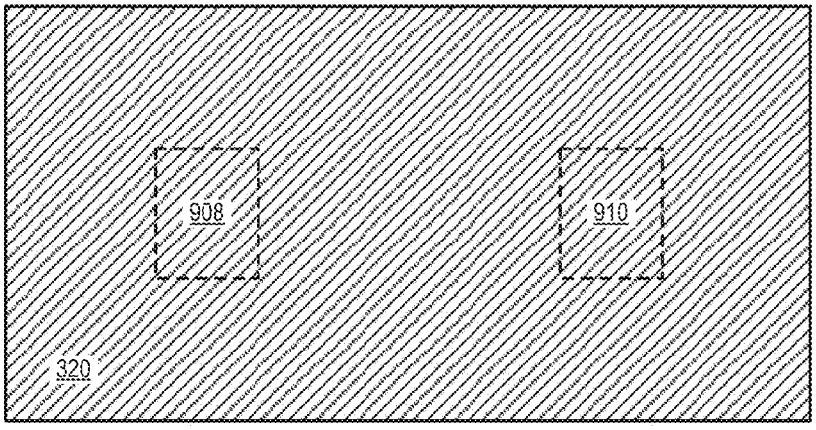
FIG. 9
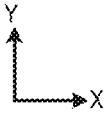

RECONFIGURABLE WAVEGUIDE INTERFACE ASSEMBLY FOR TRANSMIT AND RECEIVE ORIENTATIONS

CROSS-REFERENCE TO RELATED APPLICATIONS

The present application claims priority to U.S. Patent Application Ser. No. 61/804,436, filed on Mar. 22, 2013 and entitled "RF SYSTEM-IN-PACKAGE WITH MICROSTRIP-TO-WAVEGUIDE TRANSITION AND RECONFIGURABLE WAVEGUIDE INTERFACE ASSEMBLY", the entirety of which is incorporated by reference herein.

The present application is related to the following co-pending applications, the entireties of which are incorporated by reference herein:

U.S. patent application Ser. No. 13/870,472, filed on even date herewith and entitled "RF SYSTEM-IN-PACKAGE WITH MICROSTRIP-TO-WAVEGUIDE TRANSITION"; and U.S. patent application Ser. No. 14/217,682, filed on even date herewith and entitled "DUAL-TAPERED MICROSTRIP-TO-WAVEGUIDE TRANSITION".

FIELD OF THE DISCLOSURE

The present disclosure relates generally to antennas and more particularly to microstrip-to-waveguide transitions.

BACKGROUND

Microwave radio frequency (RF) transmission systems typically are point-to-point, and thus often utilize waveguides to focus, or restrict, the direction of propagation of the electromagnetic (EM) signaling to a desired direction. To provide a microstrip-to-waveguide transition, a microstrip feedline typically is inserted near the closed end of the waveguide, which then acts to either to focus EM signaling emitted by the feedline or to focus received EM signaling to the feedline. Conventionally, the microstrip-to-waveguide transition is achieved by introducing the microstrip feedline through an aperture in a transverse wall of a monolithic waveguide. Impedance matching is achieved by shorting a back wall of the waveguide proximate to the microstrip feedline by locating the feedline within a quarter-wavelength of the EM signaling of the back wall. In some conventional approaches, this spacing is achieved by partially filling the back of the waveguide with dielectric material and then inserting the microstrip feedline. However, errors in the fabrication of the microstrip feedline or misalignment when inserting the microstrip feedline into the waveguide can result in erroneous positioning of the microstrip feedline relative to the back wall, and thus can degrade the performance of the microstrip-to-waveguide transition. The impact of such fabrication and assembly errors is particularly manifest in systems intended for communicating millimeter-wave (mmW) frequencies of 30 gigahertz (GHz) and higher due to the relatively tight design tolerances for such systems.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

FIG. 7 is a top view of a top metal layer of a substrate of an RF circuit package in accordance with some embodiments of the present disclosure.

FIG. 8 is a top view of an intermediary metal layer of a substrate of an RF circuit package in accordance with some embodiments of the present disclosure.

FIG. 9 is a top view of a bottom metal layer of a substrate of an RF circuit package in accordance with some embodiments of the present disclosure.

DETAILED DESCRIPTION

Figure 1:
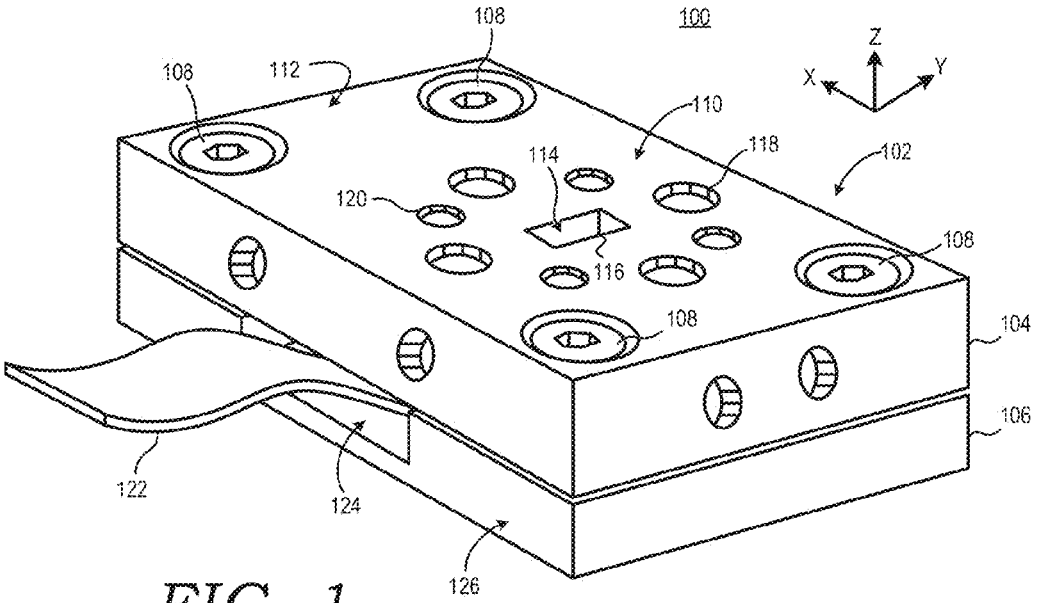
FIG. 1 is a perspective view of a waveguide interface assembly of a microwave antenna device in accordance with some embodiments of the present disclosure.

The following description is intended to convey a thorough understanding of the present disclosure by providing a number of specific embodiments and details involving the fabrication and use of a radio-frequency (RF) circuit device and corresponding microwave antenna device. It is understood, however, that the present disclosure is not limited to these specific embodiments and details, which are examples only, and the scope of the disclosure is accordingly intended to be limited only by the following claims and equivalents thereof. It is further understood that one possessing ordinary skill in the art, in light of known systems and methods, would appreciate the use of the invention for its intended purposes and benefits in any number of alternative embodiments, depending upon specific design and other needs. Moreover, unless otherwise noted, the figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the disclosed embodiments.

FIGS. 1-18 illustrate example microwave antenna devices, waveguide interface assemblies, RF circuit devices, and methods of their operation and fabrication. In some embodiments, a microwave antenna device includes an RF circuit device, such as a system-in-package (SIP) or other circuit package, contained in a cavity of a waveguide interface assembly. The waveguide interface assembly comprises a waveguide interface having a waveguide channel that extends from a surface of the cavity to an external surface. This waveguide channel forms a distal portion of a waveguide. The metal layers and certain metal vias of the substrate of the RF circuit package together effectively form a microstrip-to-waveguide transition that includes both a proximal portion of the waveguide and a microstrip feedline, with the metal layer implementing the ground plane also serving as the back wall of the waveguide. The waveguide interface assembly and the RF circuit device are configured such that when the RF circuit device is inserted in the cavity of the waveguide interface assembly, the internal opening of the waveguide channel at the cavity aligns with a waveguide opening in the metal layers that surround a probe element (also known as a "launcher") of the microstrip feedline. Accordingly, when combined, the waveguide interface assembly and the EF circuit package together form a shorted waveguide with a "planar" microstrip-to-waveguide transition (that is, a microstrip-to-waveguide transition implemented in the plane represented by the substrate). In this approach, the thickness of the substrate between the ground plane and the top metal layer implementing the microstrip feedline defines the distance between the probe element of the microstrip feedline and the "back wall" (i.e., the ground plane) of the waveguide. Thus, because the substrate can be readily fabricated to very tight tolerances, a quarter-wavelength distancing of the probe element and the "back wall" can more reliably be achieved, and thus more reliably providing suitable impedance matching characteristics. As described below, testing of an apparatus fabricated in accordance with the teachings below has demonstrated a bandwidth of at least 14 GHz and an insertion loss as low as 0.25 decibels (dB) at a 60 GHz center frequency.

Moreover, in certain embodiments, the microwave antenna device is reconfigurable as either an RF transmitter or an RF receiver. To this end, the RF circuit device includes dual microstrip line configurations: one microstrip line configuration having a microstrip line and corresponding substrate-implemented microstrip-to-waveguide transition that is for transmission; and another microstrip line configuration having a microstrip line and a corresponding substrate-implemented microstrip-to-waveguide transition that is for reception. To accommodate selection between using one microstrip line configuration or the other, the waveguide interface assembly is configured as an upper assembly having the hollow waveguide channel and a lower assembly to bracket or brace the RF circuit package. The upper assembly can be removably attached to the lower assembly in two different orientations, where the two orientations represent a 180 rotation relative to the lower assembly. In one orientation, the upper assembly, lower assembly and RF package are positioned such that the interior, or cavity, opening of the waveguide channel is aligned with a waveguide opening in the top metal layer that surrounds a probe element of the microstrip line of one of the two microstrip line configurations. In the other orientation, the upper assembly, lower assembly, and RF package are positioned such that the interior opening of the waveguide channel is aligned with a waveguide opening in the top metal layer that surrounds a probe element of the microstrip line of the other microstrip line configuration. As such, the microwave antenna device can be converted between a transmission mode and a reception mode by manipulating the upper assembly between the two orientations relative to the lower assembly.

FIG. 1 illustrates a perspective view of a microwave antenna device 100 in accordance with some embodiments of the present disclosure. The microwave antenna device 100 is operated to communicate electromagnetic (EM) signaling on behalf of an associated external signal processing device (not shown). The communication of EM signaling can include wirelessly transmitting signaling (that is, the microwave antenna device 100 driving electrical current signaling to generate the electromagnetic signaling), wirelessly receiving signaling (that is, receiving the electromagnetic signaling from another source and converting it to electrical current signaling for provision to the signal processing device), or both. For ease of illustration, the microwave antenna device 100 is described in the example context of millimeter wave (mmW) signaling, and more particularly signaling conducted at a bandwidth having a center frequency of around 60 GHz (e.g., 55-65 GHz), as may be in found in small cell backhaul systems for wireless cellular networks. However, the described herein are not limited to this context, but instead may be utilized for communicating signaling at frequencies for which waveguides can be implemented.

In the depicted example, the microwave antenna device 100 includes a waveguide interface assembly 102 and an RF circuit package or other RF circuit device (not shown in FIG. 1). The waveguide interface assembly 102 comprises an upper assembly 104 and a lower assembly 106 ("upper" and "lower" being relative to each other and relative to the view presented by FIG. 1) composed of one or more metals or other conductive materials, such as one or a combination of aluminum (Al), copper (Cu), nickel (Ni), brass, or other metals or metal alloys. The upper assembly 104 and the lower assembly 106 (collectively, "the assemblies 104 and 106") are removably attachable using any of a variety of removable fasting mechanisms, such as a set of machine bolts 108 and corresponding bolt holes, clamps, press-fit pins and corresponding pin holes, elastic bands, and the like. When attached together, the assemblies 104 and 106 form an internal cavity to contain and secure the RF circuit package.

The upper assembly 104 implements a waveguide flange interface 110 at an external surface 112. In the depicted example, waveguide flange interface 110 is implemented at a top surface of the upper assembly 104, however, as described below with reference to FIG. 17, the waveguide flange interface 110 instead may be implemented at a side surface of the upper assembly 104 ("top" and "side" being relative to the view of FIG. 1). The waveguide flange interface 110 includes a waveguide channel 114 having an external opening 116 at the external surface 112, wherein the waveguide channel 114 extends from the external opening 116 to a corresponding internal opening at an internal surface (not shown in FIG. 1) of the upper assembly 104 that forms part of the internal cavity created by the assemblies 104 and 160 when attached together. The waveguide flange interface 110 further includes a set of attachment points that serve to electrically and mechanically attach and align a flange of an antenna or another waveguide (not shown in FIG. 1) to the upper assembly 104 such that the waveguide aperture of the attached flange aligns with the external waveguide opening 116. The attachment points can include, for example, bolt holes 118 to receive bolts used to attach the antenna flange to the upper assembly 104 and alignment holes 120 to receive dowel pins to facilitate the proper alignment and orientation of the flange to be attached.

The waveguide channel 114 can comply with any of a variety of waveguide standards, such as the Electronic Industries Alliance (EIA) WR waveguide standards or the Radio Components Standardization Committee (RCSC) WG waveguide standards. The waveguide channel 114 and the attachment points can be formed to comply with any of a variety of waveguide flange interface standards, such as an EIA CMR or CPR flange standard, a U.S. military standard MIL-DTL-3922 flange standard, an International Electrotechnical Commission (IEC) standard IEC 60154 flange standard, and the like. For exemplary purposes, the waveguide flange interface 110 is illustrated with the waveguide channel 114 a WR15-compliant waveguide with sharp corners. However, in implementation, it may be more cost-effective to form the waveguide channel 114 with rounded corners, which the inventors have found does not materially impact the performance of the waveguide channel 114.

As described in detail below with reference to FIGS. 15 and 16, in some embodiments the waveguide has separate transmission and reception configurations. These separate configurations are supported by the use of two microstrip feedlines implemented at separate locations in the RF circuit package. One of the microstrip feedlines is used by RF circuitry of the RF circuit package for transmitting RF signaling, and the other microstrip feedline is used by the RF circuitry for receiving RF signaling. The locations of the microstrip feedlines on the RF circuit package and the position of the RF circuit package when disposed in the interior cavity of the waveguide interface assembly 102 are such that the interior opening of the waveguide channel 114 is selectively positioned over one of the two microstrip feedline locations. The upper assembly 104 then can be detached from the lower assembly 106, rotated 180 degrees about its Z-axis, and then reattached to the lower assembly 106 so as to reposition the interior opening of the waveguide channel 114 over the other microstrip feedline locations. Thus, the antenna waveguide interface assembly 102 can be converted between the transmission configuration and the reception configuration by rotating the upper assembly 104 between its two orientations relative to the lower assembly 106.

To facilitate this reconfigurability, in some embodiments the external waveguide opening 116 is positioned along the centerline of the external surface 112 along the X-axis and offset from the centerline of the external surface 112 along the Y-axis. In this manner, when the upper assembly 104 is detached from the lower assembly 106, rotated from the illustrated position 180 degrees around the Z-axis, and then reattached to the lower assembly 106 in this rotated orientation, position of the external waveguide opening 116 in the illustrated orientation and the position of the waveguide opening in the rotated orientation are symmetrical about the centerline along the Y-axis. Thus, if the internal cavity and the RF circuit package are configured such that the two microstrip locations are offset from this centerline by the same offset distance, the internal waveguide opening will align to one or the other microstrip locations, depending on which of the two orientations the upper assembly 104 is positioned. For ease of reference, the orientation of the upper assembly 104 depicted in FIG. 1 is referred to herein as the "0 orientation", and the orientation of the upper assembly 104 when rotated 180 degrees from the depicted orientation is referred to herein as the "180° orientation".

In other embodiments, the dual-mode operation of the waveguide interface assembly 102 can be provided by implementing a second hollow waveguide channel and a second waveguide flange interface at a separate location on the external surface 112. In this configuration, two antennas or other waveguides can be attached the waveguide interface assembly 102 simultaneously, and the switch between a transmitter mode and a receiver mode can be made at the RF circuit package without requiring mechanical reconfiguration. However, this approach typically requires significant spacing between the two external waveguide openings to facilitate the dimensions of the attached waveguide flanges and corresponding antenna, and thus requires significant spacing between the locations of the probe elements of the two microstrip feedlines. This long spacing requires correspondingly long microstrips feedlines, and thus can negatively impact the performance of the microwave antenna device 100.

The RF circuit package is coupled to the external signal processing device via a cable interconnect 122 or other wiring. To facilitate the connection to the RF circuit package while in the internal cavity, the waveguide interface assembly 102 includes a connector aperture 124 that extends from an external surface of the waveguide interface assembly 102 to the internal cavity. To facilitate the dual-orientation of the upper assembly 104, the connector aperture 124 can be formed fully within a side 126 of the lower assembly 106 so that the connector aperture 124 is not affected by the rotation of the upper assembly 104 relative to the lower assembly 106.

Figure 2:
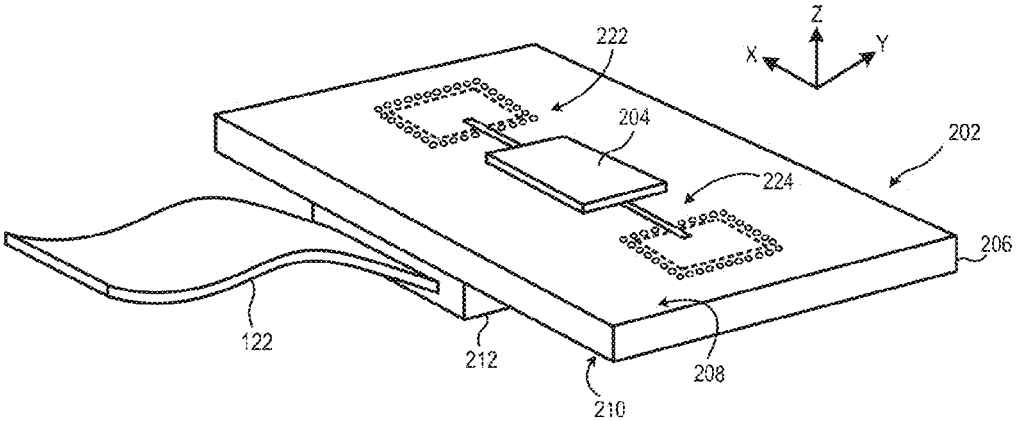
FIG. 2 is a perspective view of an RF circuit package implementing dual planar microstrip-to-waveguide transitions in accordance with some embodiments of the present disclosure.

FIG. 2 illustrates a perspective view of an example of the RF circuit device of the microwave antenna device 100 as an RF circuit package 202 in accordance with some embodiments of the present disclosure. In the depicted example, the RF circuit package 202 is implemented as a system-in-package (SIP) comprising an integrated circuit (IC) die 204 and other circuit components disposed at a substrate 206. The IC die 204 is disposed at a surface 208 of the substrate 206 and implements circuitry for a radio and baseband system to provide RF transmission functionality, RF reception functionality, or both. The IC die 204 can be implemented as, for example, a controlled collapse chip connection (C4) also known as a "flip chip") whereby solder balls or bumps are used to connect input/output (I/O) to corresponding bump pads of the substrate 206, a wirebonded die, and the like. The RF circuit package 202 also includes external circuit components disposed at the surface 208, or at an opposing surface 210 of the substrate, to support the operation of the IC die 204. To illustrate, the RF circuit package 202 can include a crystal oscillator and one or more discrete resistor and capacitors (not shown) disposed at, for example, the surface 210. Further, the RF circuit package 202 includes a cable connector 212 to connect the RF circuit package 202 to the cable interconnect 122, and thus the external signal processing device. In the illustrated embodiment, the cable connector 212 is disposed at the surface 210 of the substrate 206. The various components of the RF circuit package 202 are interconnected using metal traces formed at one or more metal layers of the substrate 206 and metal vias extending between the various metal layers. Although FIG. 2 illustrates the IC die 204 as disposed at the surface 208, in other embodiments, the IC die 204 may be disposed at the surface 208, whereupon one or more pins of the IC die 204 may be coupled to features at the surface 204 using through holes or through-silicon vias (TSVs).

In the illustrated implementation, the RF circuit package 202 supports dual-mode operation and thus implements two microstrip-to-waveguide transitions 222 and 224. For the following examples, the microstrip-to-waveguide transition 222 is utilized when the upper assembly 104 is in the 180° orientation (e.g., for a receive mode) and the microstrip-to-waveguide transition 224 is utilized when the upper assembly 104 is in the 0° orientation (e.g., for a transmit mode). In other embodiments, the RF circuit package 202 may support only a single-mode operation and thus implements a single microstrip-to-waveguide transition. As described in detail below, the microstrip-to-waveguide transitions 222 and 224 each form a proximate section of a waveguide implemented using a region of the ground plane (not shown in FIG. 2) proximate to the surface 210 and a plurality of metal vias extending from the top metal layer to the ground plane and which define the perimeter of a region or cavity below a corresponding probe element of a microstrip feedline that is substantially devoid of conductive material. Thus, the corresponding region of the ground plane effectively serves as the "back wall" of a corresponding waveguide and the plurality of vias effectively serve as an initial section of the "side walls" and waveguide opening for the corresponding waveguide segment. As many semiconductor fabrication processes can control the layer dimensions of the substrate 206 to tight dimensional tolerances, this arrangement permits the probe element to be accurately located an appropriate distance from the effective "back wall" and "side walls" for an intended center frequency with reduced opportunity for fabrication error or assembly misalignment and thus more reliably providing the appropriate shorting between the probe element and the waveguide at the intended center frequency.

Figure 3:
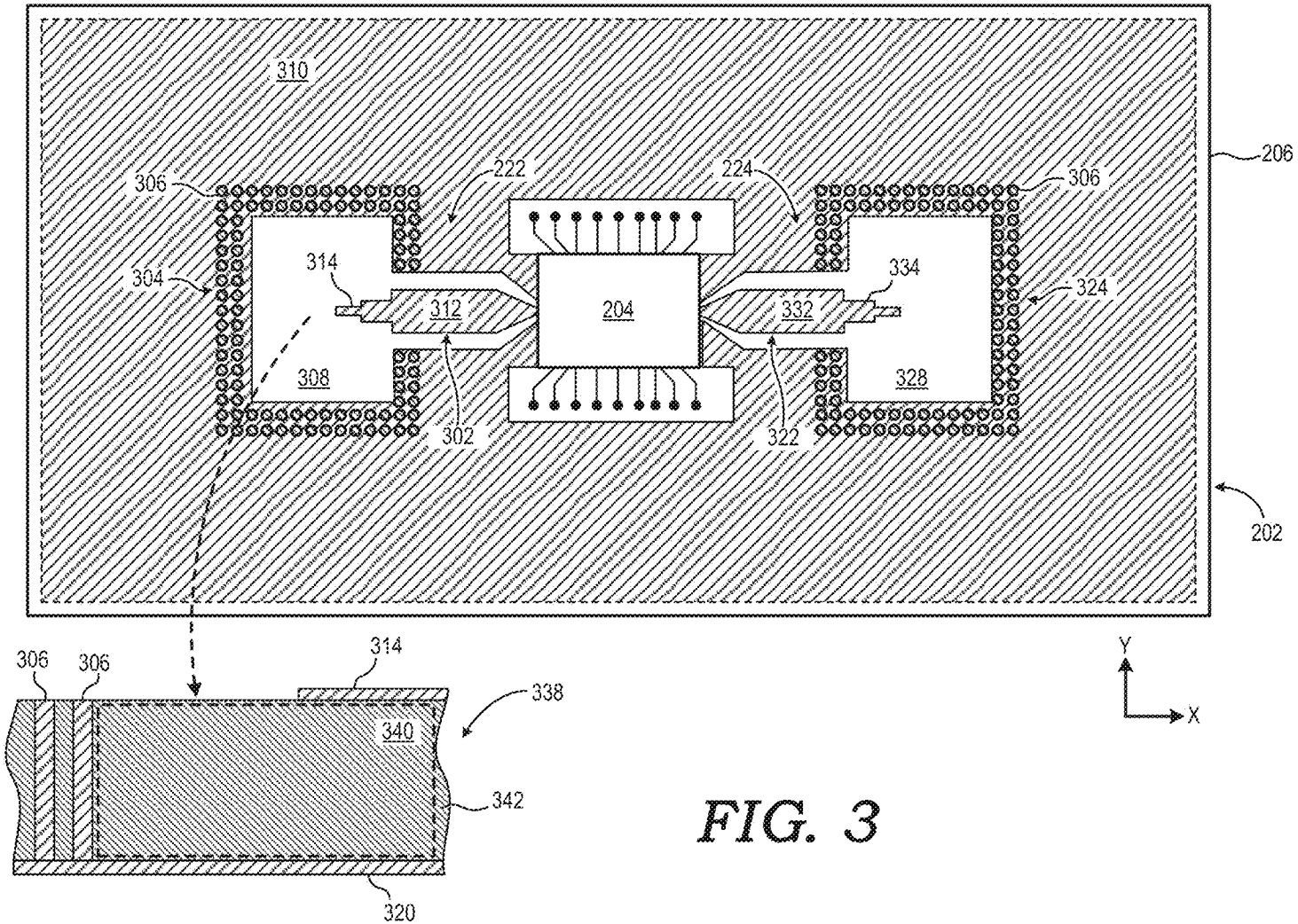
FIG. 3 is a top view of an RF circuit package in accordance with some embodiments of the present disclosure.

FIG. 3 illustrates a top plan view of the RF circuit package 202 in accordance with at least some embodiments of the present disclosure. The microstrip-to-waveguide transition 222 includes a microstrip feedline 302 and a "wall" 304 of metal vias 306 forming a perimeter of an open region 308. The microstrip feedline 302 is formed at a top metal layer 310 of the substrate 206 and comprises a continuous metal trace forming a microstrip element 312 and a probe element 314 and that extends from a region coaxial with the IC die 204 into the open region 308. The microstrip element 312 extends from a bump pad (not shown in FIG. 3) connected to a pin of the IC die 204 to the perimeter of the open region 308. In embodiments wherein the IC die 204 is disposed on the surface 210, the pin can be connected to the bump pad via, for example, a through hole or a TSV. The probe element 314 extends into the open region 308 from the perimeter. As such, the open region 308 surrounds the probe element 314. The metal vias 306 of the wall 304 extend from the top metal layer 310 to the ground plane 320 formed by a bottom metal layer of the substrate 206.

The microstrip-to-waveguide transition 224 is similarly configured and includes a microstrip feedline 322 and a "wall" 324 of metal vias 306 forming a perimeter of an open region 328. The microstrip feedline 322 comprises a continuous metal trace forming a microstrip element 332 and a probe element 334 that extend from another bump pad connected to a different pin of the IC die 204 into the open region 328. The microstrip element 332 extends from a region coaxial with the IC die 204 (e.g., coaxial with the other bump pad) to the perimeter of the open region 328. The probe element 334 extends into the open region 328 from the perimeter. The metal vias 326 of the wall 304 extend from the top metal layer 310 to the ground plane 320 of the substrate 206. To effectively form a metal "wall" of a waveguide for signaling conducted at a bandwidth having a center frequency $f_C$, in at least one embodiment, the metal vias 306 are positioned so as to be not more than 10% of the wavelength at the center frequency $f_C$ from each other. The metal vias 326 likewise may be so positioned relative to each other.

In at least one embodiment, the regions 308 and 328 substantially defined by the walls 304 and 324, respectively, of metal vias 306 and the underlying ground plane 320 are, with the exception of the probe elements 314 and 334, substantially devoid of conductive material. Thus, as illustrated by cross-sectional view 338 of a portion of the RF circuit package 202 in the location of the probe element 314, the regions 308 and 328 define respective dielectric cavities (e.g., cavity 340) formed in the one or more dielectric layers 342 of the substrate 206 between the ground plane 320 and the corresponding probe element. Thus, when the RF circuit package 202 is assembled in the waveguide interface assembly 102 and the upper assembly 104 is oriented in its transmission orientation, the portion of the ground plane in open region 308, the dielectric cavity 340 represented by the open region 308, and the metal vias 306 defining the perimeter of the open region 308 together effectively form the back wall and side wall segments of the proximate, or closed-end, portion of a waveguide, with the waveguide channel 114 (FIG. 1) of the upper assembly 104 aligning with the waveguide opening represented by the open region 308, and thus forming the distal, or open-end, portion of the waveguide. Similarly, when the upper assembly 104 is oriented in its reception orientation, the portion of the ground plane in open region 328, the dielectric cavity represented by the open region 328, and the metal vias 306 defining the perimeter of the open region 328 together effectively form the back wall and side wall segments of the proximate portion of a waveguide, with the waveguide channel 114 (FIG. 1) of the upper assembly 104 aligning with the waveguide opening represented by the open region 328 and thus forming the distal, or open-end, portion of the waveguide.

Figure 4:
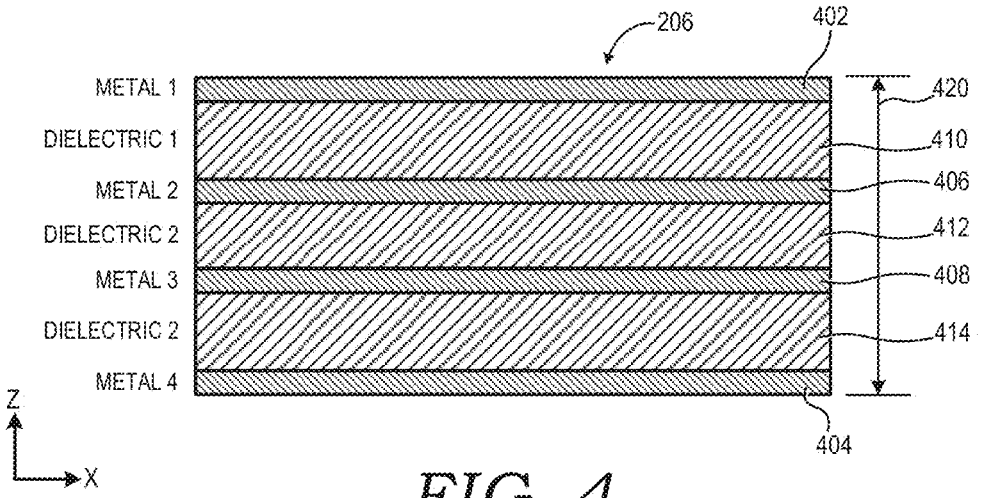
FIG. 4 is a cross-sectional view of a portion of an example substrate of an RF circuit package in accordance with some embodiments of the present disclosure.
Figure 5:
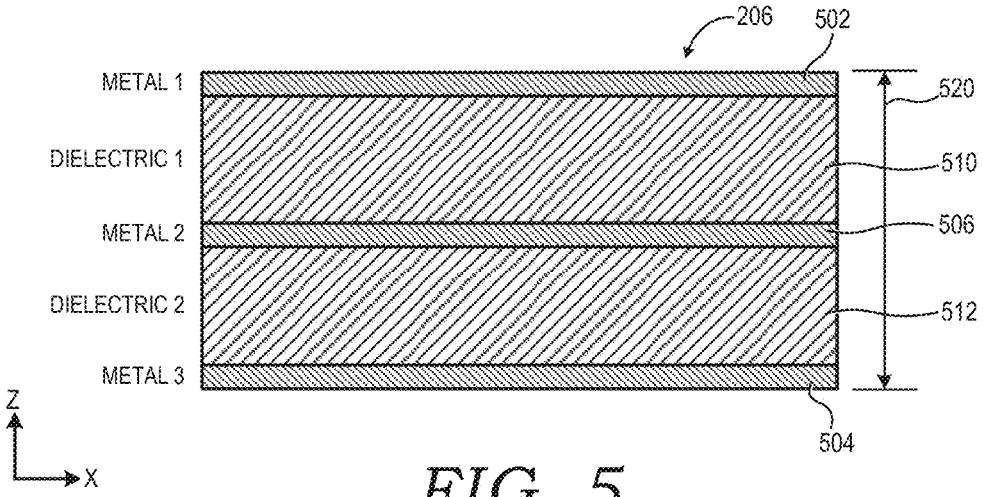
FIG. 5 is a cross-sectional view of a portion of another example substrate of an RF circuit package in accordance with some embodiments of the present disclosure.
Figure 6:
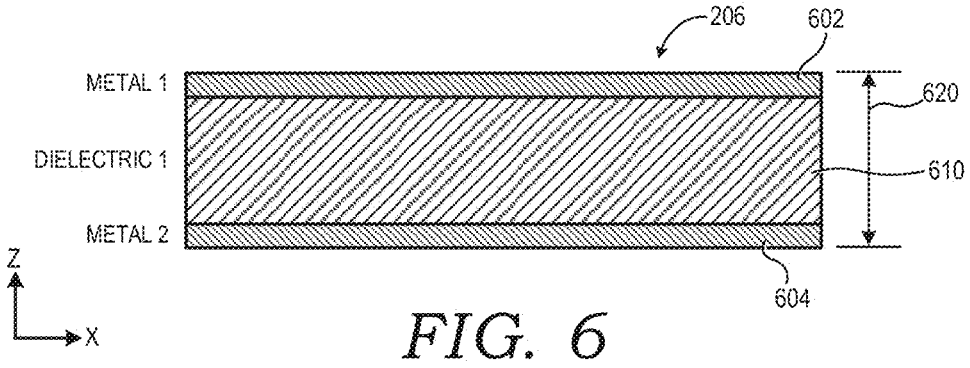
FIG. 6 is a cross-sectional view of a portion of yet another example substrate of an RF circuit package in accordance with some embodiments of the present disclosure.

As the distance between the corresponding probe element and the ground plane 320 defines the distance between the probe element and the "back wall" of the resulting waveguide, the layers of the substrate 206 can be fabricated to provide a precise specified distance between the probe element and the ground plane, and thus facilitate the desired quarter-wavelength spacing for grounding at a specified center frequency in a manner that is less susceptible to assembly misalignment or fabrication error. FIGS. 4-6 illustrate example layer configurations of the substrate 206 to provide this precise distancing in accordance with some embodiments.

FIG. 4 illustrates a four metal layer configuration of the substrate 206. In this configuration, the substrate 206 includes a top metal layer 402 (one embodiment of the top metal layer 310, FIG. 3) proximate to the top surface 208 (FIG. 2) of the substrate 206, a bottom metal layer 404 (one embodiment of the ground plane 320, FIG. 3) proximate to the bottom surface 210 (FIG. 1) of the substrate 206, and two intermediary metal layers 406 and 408 disposed between the metal layers 402 and 404. The metal layers 402-408 can comprise any of a variety of metals or metal alloys, or combinations thereof, such as copper (Cu), aluminum (Al). Silver (Ag), gold (Au), nickel (Ni), and the like. The metal layers 402-408 can be formed, for example, by forming, adhering, or otherwise disposing a metal sheet or foil (e.g., a copper or gold foil) at a surface of the corresponding dielectric layer and then etching or ablating the metal material to define the dimensions of the metal elements of the metal layer as described herein. Alternatively, the metal layers can be formed via a metal deposition or plating process. For example, the metal layers can be formed via a copper damascene process.

The top metal layer 402 can be used to implement the microstrip feedlines 302 and 322 (FIG. 3) and bump pads and other surface wiring for the IC die 204 (FIG. 2). The bottom metal layer 404 can be used as the ground plane 320 (FIG. 3), as well as for providing bump pads and other surface routing for the cable connector 212 (FIG. 2) and other components mounted at the bottom surface 210 of the substrate 206. One or both of the intermediary metal layers 406 and 408 may be used, in conjunction with inter-layer vias, for trace routing between the surface components.

The substrate 206 further includes dielectric layers 410, 412, and 414, wherein the dielectric layer 410 is disposed between the metal layers 402 and 406, the dielectric layer 412 is disposed between the metal layers 406 and 408, and the dielectric layer 414 is disposed between the metal layers 408 and 404. The dielectric layers 410-414 can comprise any of variety of dielectric materials, or combinations thereof, that are suitable for low-loss, high frequency operation, such as polytetrafluoroethylene, epoxy resins such as FR-4 and FR-1, HL972, CEM-1, CEM-3, Arlon 25N, GETEK, liquid crystal polymer (LCP), ceramics, Teflon, and the like.

The depicted implementation of the substrate 206 may be fabricated from multiple printed circuit board (PCB) core layers aligned in the Z-plane and bonded using adhesive, heat, and pressure. To illustrate, the metal layers 402 and 406 and the dielectric layer 410 may be formed as one PCB layer, and the metal layers 408 and 404 and the dielectric layer 414 may be formed as a second PCB layer. The two PCB layers then may be aligned and bonded using a preimpregnated (prepreg) layer represented by the dielectric layer 412.

As noted, it often is intended to space the microstrip feedlines 302 and 322 (FIG. 3) a quarter-wavelength from the ground plane 320 so as to provide the desired shorting effect at a specified center frequency. As the microstrip feedlines 302 and 322 are implemented in the top metal layer 402 in this example and the ground plane 320 is implemented in the bottom metal layer 404 in this example, in at least one embodiment, the thickness of the layers are selected (in accordance with factory design rules) so that the resulting total, or combined, thickness 420 of the substrate 206 provides a quarter-wavelength distance between the top metal layer 402 and the bottom metal layer 404. To illustrate, the guided wavelength $\lambda_g$ of a signal at a center frequency f is represented by the following equation:

$$\lambda_g = \frac{c}{f\sqrt{\varepsilon r}}$$

where c represents the speed of light, and er represents the dielectric constant of the dielectric material. Accordingly, at a center frequency f=60 GHz and assuming a dielectric constant $\in$r=2.16 for an organic dielectric material, the resulting quarter of the guided wavelength $\lambda_g$ is ¼ $\lambda_g$=850 micrometers. Thus, assuming the metal layers are copper layers approximately 20 micrometers thick, a spacing of approximately 850 micrometers (e.g., 850+/−50 micrometers) between the top metal layer 402 and the bottom metal layer 404 can be achieved by, for example, implementing the dielectric layers 410 and 414 as organic core layers having a thickness of 350 micrometers and implementing the dielectric layer 412 as a prepreg layer with a thickness of 70 micrometers, resulting in a total thickness 420 of 850 micrometers for the substrate 206.

FIG. 5 illustrates a three metal layer configuration of the substrate 206. In this configuration, the substrate 206 includes a top metal layer 502 (one embodiment of the top metal layer 310, FIG. 3) proximate to the top surface 208 (FIG. 2) of the substrate 206, a bottom metal layer 504 (one embodiment of the ground plane 320, FIG. 3) proximate to the bottom surface 210 (FIG. 1) of the substrate 206, and one intermediary metal layer 506 disposed between the metal layers 502 and 504. A dielectric layer 510 is disposed between the metal layers 502 and 506, and a dielectric layer 512 is disposed between the metal layers 506 and 504. The top metal layer 502 is used to implement the microstrip feedlines 302 and 322 (FIG. 3) and bump pads and other surface wiring for the IC die 204 (FIG. 2). The bottom metal layer 504 can be used as the ground plane 320 (FIG. 3), as well as for providing bump pads and other surface routing for the cable connector 212 (FIG. 2) and other components mounted at the bottom surface 210 of the substrate 206. The intermediary metal layer 506 may be used, in conjunction with inter-layer vias, for trace routing between surface components.

As with the implementation of FIG. 4, in at least one embodiment the thicknesses of the layers of the substrate 206 illustrated in FIG. 5 are selected in accordance with factory design rules to provide a total thickness 520 that is substantially equal to the guided quarter-wavelength of a signal at the intended center frequency. As an example, to provide a quarter-wavelength spacing of 850 micrometers for a 60 GHz application, the metal layers 502-506 each may be designed to each be 20 micrometer thick and the dielectric layers 510 and 512 may be designed to each be 400 micrometers thick, thereby providing a total thickness 520 of 860 micrometers.

FIG. 6 illustrates a two metal layer configuration of the substrate 206. In this configuration, the substrate 206 includes a top metal layer 602 (one embodiment of the top metal layer 310, FIG. 3) proximate to the top surface 208 (FIG. 2) of the substrate 206 and a bottom metal layer 604 (one embodiment of the ground plane 320, FIG. 3) proximate to the bottom surface 210 (FIG. 1) of the substrate 206. A dielectric layer 610 is disposed between the metal layers 602 and 604. The top metal layer 602 is used to implement the microstrip feedlines 302 and 322 (FIG. 3) and bump pads and other surface wiring for the IC die 204 (FIG. 2). The bottom metal layer 604 can be used as the ground plane 320 (FIG. 3), as well as for providing bump pads and other surface routing for the cable connector 212 (FIG. 2) and other components mounted at the bottom surface 210 of the substrate 206. In at least one embodiment the thicknesses of the layers of the substrate 206 illustrated in FIG. 6 are selected in accordance with factory design rules to provide a total thickness 620 that is substantially equal to the guided quarter-wavelength of a signal at the intended center frequency. As an example, for a 60 GHz application, the metal layers 602 and 604 each may be designed to each be 20 micrometer thick and the dielectric layer 610 may be designed to each be 800 micrometers thick, thereby providing a total thickness 620 of 840 micrometers.

FIGS. 7-9 illustrate top views of top, intermediary, and bottom metal layers that may be implemented in, for example, the configurations of the substrate 206 of FIGS. 4-6. For ease of illustration, the illustrated views are simplified views illustrating the metal layer configuration as it pertains to the microstrip-to-waveguide transitions 222 and 224. Other metal layer features and other areas devoice of conductive material that may be found at the various metal layers, such as trace routes for interconnecting various other components, are omitted for clarity.

FIG. 7 illustrates a simplified top view of the top metal layer 310, which can correspond to the top metal layers 402, 502, or 602 of FIGS. 4-6, respectively. In this view, the areas of the top metal layer 310 illustrated with cross-hatching indicate areas in which conductive material is present, whereas areas illustrated without cross-hatching indicate areas substantially devoid of conductive material. As illustrated, the top metal layer 310 forms a number of open regions substantially devoid of conductive material, including open regions 702, 704, 708, and 710. The open region 702 surrounds or encompasses the microstrip element 312 of the microstrip feedline 302 so as to isolate the microstrip element 312 from the remainder of the top metal layer 310. Likewise, the open region 704 surrounds the microstrip element 312 of the microstrip feedline 322 so as to isolate the microstrip element 312 from the remainder of the top metal layer 310. The open region 708 surrounds or encompasses the probe element 314 and corresponds to the open region 308 (FIG. 3) having a perimeter at least partially defined by the wall 304 (FIG. 3) of vias 306 (omitted from FIG. 7 for clarity). Similarly, the open region 710 surrounds or encompasses the probe element 334 and corresponds to the open region 328 (FIG. 3) having a perimeter at least partially defined by the wall 324 of vias 306 (FIG. 3). As such, the open regions 708 and 710 serve as waveguide openings for the respective waveguide sections formed in the plane of the substrate 206.

FIG. 8 illustrates a simplified top view of an intermediary metal layer 802, which can correspond to the intermediary metal layers 406 and 408 of the example implementation of FIG. 4 or the intermediary metal layer 506 of the example implementation of FIG. 5. As illustrated by the metal layer 802, the conductive metal layer extends to a open region underlying the open regions 702 and 704 (FIG. 7), and thus the intermediary metal layer 802 can act as a ground plane for the microstrip elements 312 and 332 of the microstrip feedlines 302 and 322 (FIG. 3). However, the metal layer 802 includes open regions 808 and 810 substantially devoid of conductive material and which are aligned with the open regions 708 and 710 (FIG. 7), respectively, of the top metal layer 310. As such, the open regions 708 and 808 together form a dielectric opening or cavity between the probe element 314 and the ground plane 320 and the open regions 710 and 810 together form a dielectric opening or cavity between the probe element 334 and the ground plane 320. Thus, as with the open regions 708 and 710, the open regions 808 and 810 serve as waveguide openings for the respective waveguide sections formed in the plane of the substrate 206.

FIG. 9 illustrates a simplified top view of the ground plane 320, which can correspond to the bottom metal layers 404, 504, or 604 of FIGS. 4, 5, and 6, respectively. As illustrated, the conductive metal layer of ground plane 320 is present at least in regions 908 and 910, which are aligned to open regions 808 and 810. As such, the ground plane 320 serves as the ground plane for the probe elements 314 through the opening provided by the open regions 708 and 808 and as the ground plane for the probe element 334 through the opening provided by open regions 710 and 810.

Figure 10:
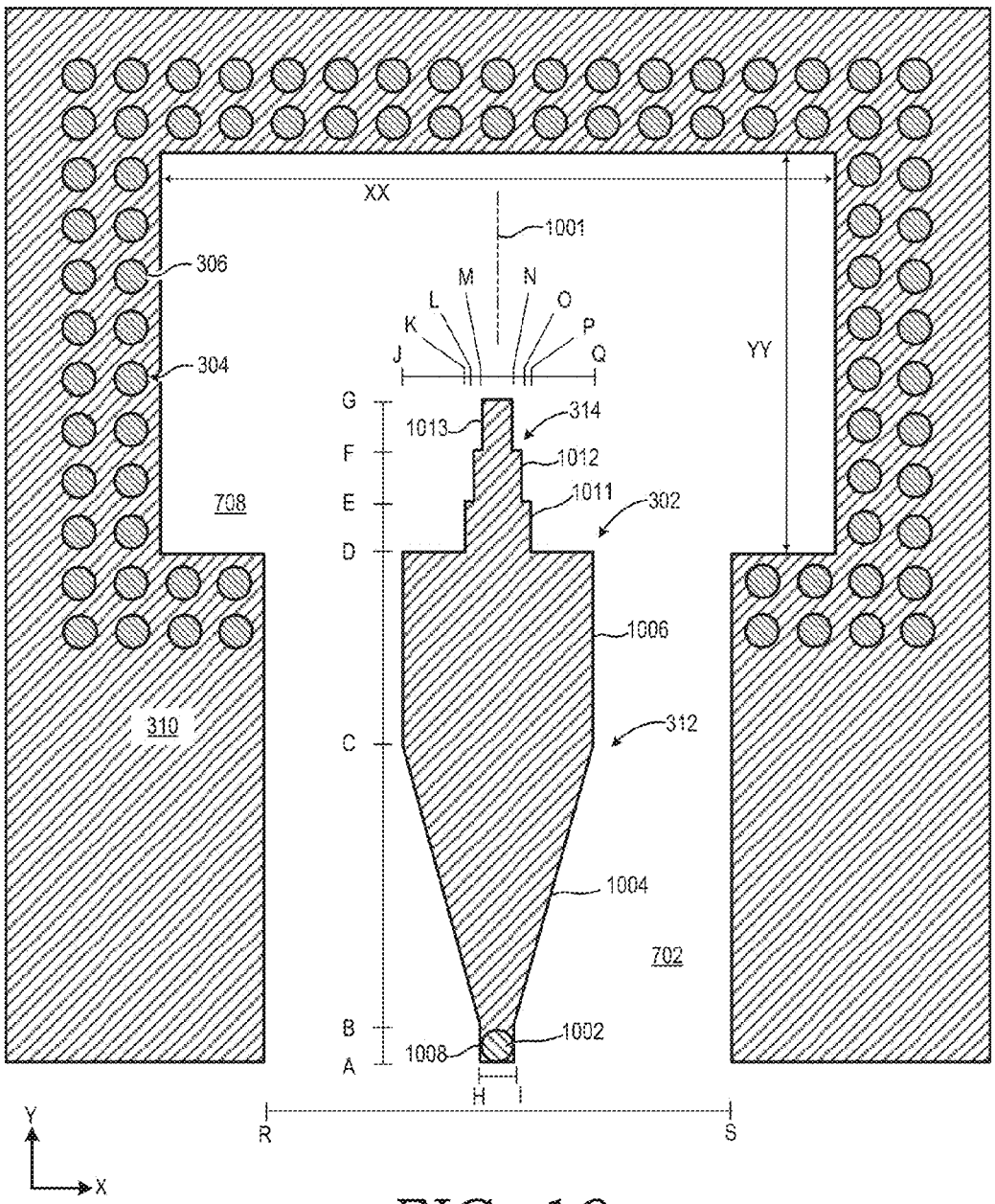
FIG. 10 is a top view of a dual-tapered microstrip feedline in accordance with some embodiments of the present disclosure.

FIG. 10 illustrates a top view of an example implementation of the microstrip feedline 302 (FIG. 3) and a surrounding area of the top metal layer 310 (FIG. 3) of the substrate 206 in accordance with at least one embodiment of the present disclosure. The microstrip feedline 322 (FIG. 3) may be similarly configured in the manner described below.

As noted above, the microstrip feedline 302 comprises a continuous metal trace that is substantially symmetric about a centerline 1001 and which forms the microstrip element 312 and the probe element 314, which are encompassed by the open region 702 and the open region 708, respectively. In the depicted example, the microstrip element 312 comprises a connection segment 1002, a taper segment 1004, and a continuous-width segment 1006 that extend from a corresponding ball or other pin of the IC die 204 (FIG. 2) toward the open region 708. The connection segment 1002 extends from the illustrated point A to point B and provides a circuit connection point 1008 (e.g., a bump pad) for the corresponding pin of the IC die 204. The continuous-width segment 1006 extends from point C to point D and has a substantially continuous width ("width" referencing the illustrated X axis). Point D is located at the perimeter of the open region 708, and thus serves as the transition point between the microstrip element 312 and the probe element 314 of the microstrip feedline 302. The taper segment 1004 extends from point B to point C, whereby the width of the taper segment 1004 tapers from a wider width substantially equal to the width of the continuous-width segment at point C to a narrower width substantially equal to the width of the connection segment 1002 at point B.

The probe element 314 extends from point D to point G in the open region 708. As illustrated, the probe element 314 can be substantially narrower than the continuous-width segment 1006 of the microstrip element 312. In some embodiments, the probe element 314 includes a series of one or more continuous-width segments with staggered widths so that the probe element 314 increasingly narrows from point D to point G. For example, in the depicted implementation, the probe element 314 includes three staggered segments 1011, 1012, and 1013 with increasingly narrow widths, whereby segment 1011 extends from point D to point E, segment 1012 extends from point E to point F, and segment 1012 extends from point F to point G.

The segments 1002, 1004, and 1006 of the microstrip element 312 typically are dimensioned so as to provide a characteristic impedance of 50 fl for impedance matching purposes and to provide a smooth transition leading to the probe element 314. The probe element 314 (e.g., the segments 10011-1013) typically are dimensioned so as provide suitable waveguide excitation at the intended center frequency band. Table I below provides example dimensions found by the inventors to be well-suited for a 60 GHz signal application:

TABLE 1

| Feature | Dimension | Value |
|---|---|---|
| Segment 1002 | Length: A-B | 0.13 mm |
| | Width: H-I | 0.13 mm |
| Segment 1004 | Length: B-C | 1.25 mm |
| | Width: H-I (start) | 0.13 mm |
| | Width: J-Q (end) | 0.75 mm |
| Segment 1006 | Length: C-D | 0.745 mm |
| | Width: J-Q | 0.75 mm |
| Segment 1011 | Length: D-E | 0.2 mm |
| | Width: K-P | 0.25 mm |
| Segment 1012 | Length: E-F | 0.2 mm |
| | Width: L-O | 0.2 mm |
| Segment 1013 | Length: F-G | 0.2 mm |
| | Width: M-N | 0.125 mm |
| Region 702 | Length: A-G | 2.595 mm |
| | Width: R-S | 1.8 mm |
| Region 708 | Length: YY | 1.598 mm |
| | Width: XX | 2.632 mm |

It will be appreciated by those skilled in the art that this combination of design parameters is just one example set of design parameters, and other design parameters may be implemented to achieve similar results for other implementations.

A perimeter of the open region 708 is defined in part by the wall 304 of metal vias 306. In the illustrated example, the wall 304 includes two rows or layers of vias. However, in other embodiments, the wall 304 can include one row or more than three rows of vias. When the spacing between the metal vias 306 of the wall 304 are below approximately $1/10^{th}$ or $1/20^{th}$ of the guided wavelength $\lambda_g$ of the center frequency of the propagated signaling, the incident electromagnetic field interacts with the wall 304 as though it were solid metal. Thus, in at least one embodiment, the metal vias 306 are spaced from each other at a distance of not more than $1/10^{th}$ of the guided wavelength $\lambda_g$ of the center frequency of the propagated signaling so that the layers of vias 306 may form an artificial metallic waveguide within the substrate 206. Thus, for a 60 GHz application, a spacing of the vias at 340 micrometers or less will permit the wall 304 to effectively operate as an electromagnetic wall for the propagated signaling.

Figure 11:
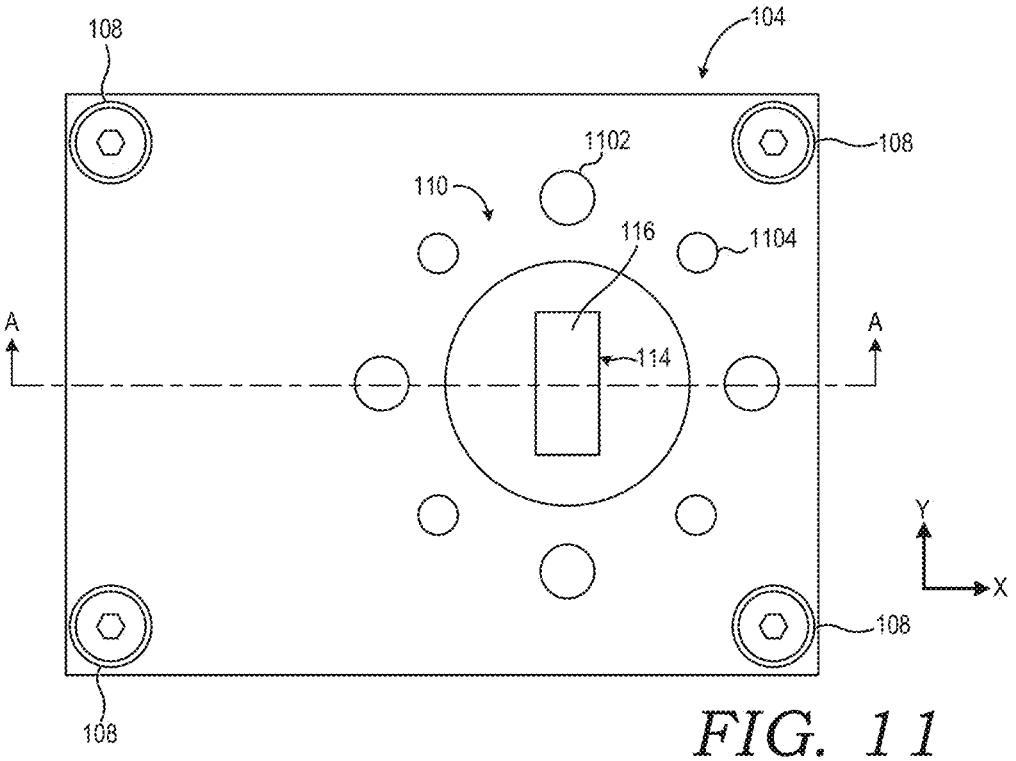
FIG. 11 is a top view of an upper assembly of a waveguide interface assembly of FIG. 1 in accordance with some embodiments of the present disclosure.

FIG. 11 illustrates a top plan view of an example implementation of the upper assembly 104 of the waveguide interface assembly 102 (FIG. 1) in accordance with at least some embodiments. As described above with reference to FIG. 1, the upper assembly 104 includes an external surface 112 at which a waveguide flange interface 110 is disposed. The waveguide flange interface 110 includes one or more attachment points 1102 and 1104, such as bolt holes, alignment pins, and the like, arranged in accordance with a standard or proprietary flange interface design. The waveguide flange interface 110 further includes the external waveguide opening 116 for the waveguide channel 114 that extends from the external surface 112 to an internal surface of the upper assembly 104 that forms at least part of the surface of an internal cavity. In the depicted example, the waveguide channel 114 is dimensioned to be compatible with the EIA WR 5 waveguide standard. The upper assembly 104 further includes bolt holes configured to accept machine bolts 108 used to fasten the upper assembly 104 to the lower assembly 106. In other embodiments, the assemblies 104 and 106 can use other types of fastening mechanisms, such as press-fit pins and holes to receive the pins, clamps, elastic or metal bands, conductive adhesive, and the like.

Figure 12:
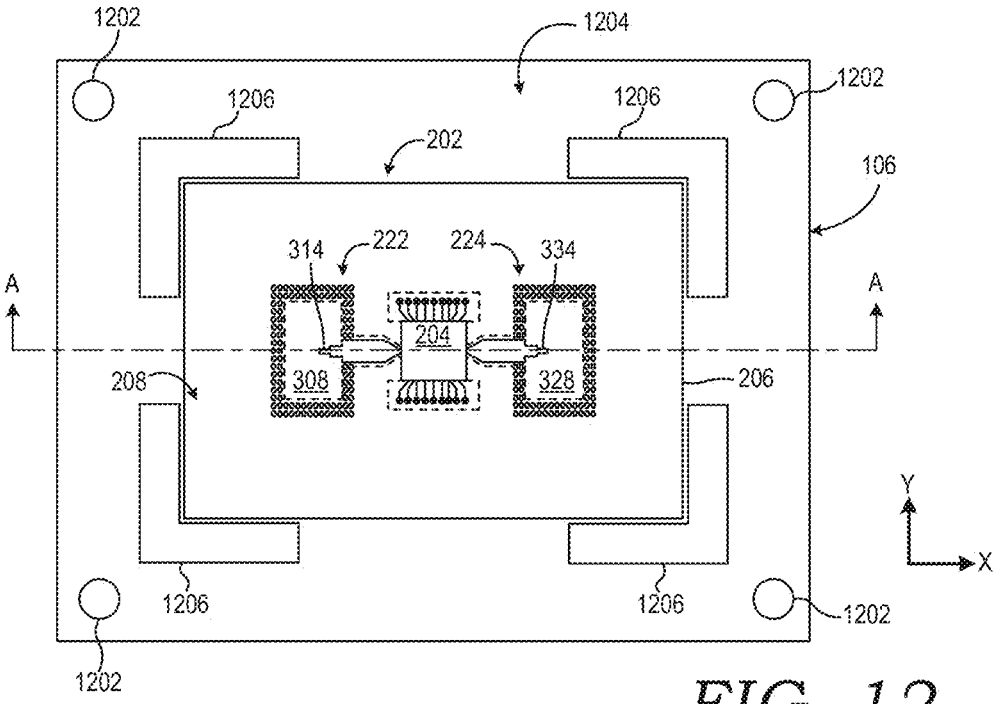
FIG. 12 is a top view of a lower assembly of the waveguide interface assembly of FIG. 1 in accordance with some embodiments of the present disclosure.

FIG. 12 illustrates a top plan view of an example implementation of the lower assembly 106 of the waveguide interface assembly 102 (FIG. 1) in accordance with at least some embodiments. The depicted view presents the surfaces of the lower assembly 106 that would face the bottom of the upper assembly 104 when the assemblies 104 and 106 are assembled. As depicted, the lower assembly 106 can be dimensioned compatibly with the dimensions of the upper assembly 104 so that the upper assembly 104 and the lower assembly 106 form a monolithic assembly when fastened together. To facilitate the removable attachment of the upper assembly 104 and the lower assembly 106, the lower assembly 106 can include attachment mechanisms compatible with the attachment mechanisms implemented at the upper assembly 104. For example, if the machine bolts 108 are employed, the lower assembly 106 can employ bolt holes 1202 at locations of a top surface 1204 that align with the bolt holes of the upper assembly 104. To permit dual-mode configuration of the waveguide interface assembly 102, the bolt holes 1202 of the lower assembly 106 and the bolt holes of the upper assembly 104 are symmetrically located about their centerlines in the X and Y directions so that the bolt holes of the assemblies 104 and 106 align regardless of whether the upper assembly 104 is in the 0° orientation or the 180° orientation.

When assembled as the waveguide interface assembly 102 (FIG. 1), the assemblies 104 and 106 together form an internal cavity to contain the RF circuit package 202. To this end, the lower assembly 106 includes a recess or other cavity to accommodate some or all of the thickness of the substrate 206 as well as the circuit components and cable connector 212 (FIG. 2) disposed at the bottom surface 210 of the substrate 206. Further, the lower assembly can employ various retention mechanisms to maintain the RF circuit package 202 in the lower assembly 106 while the upper assembly 104 is being manipulated, such as when the upper assembly 104 is being rotated between the 0° and 180° orientations. These alignment/retention mechanisms can include, for example, alignment/retention walls 1206 disposed at the surface 1204, which are located and dimensioned so as to provide a press-fit relationship with the sidewalls of the substrate 206 of the RF circuit package 202 when inserted between the alignment/retention walls 1206. The upper assembly 104 then can include a cavity dimensioned and positioned to receive the alignment/retention walls 1206 and the RF circuit package 202. In other embodiments, a recess is formed at the top surface 1204 to receive the RF circuit package 202 such that the top surface 208 of the substrate 206 is at or below the level of the top surface 1204. Other suitable alignment/retention mechanisms can include clamps, bolts or screws, adhesives, hook-and-loop fasteners, and the like.

Whatever form of fastener mechanism employed, the assemblies 104 and 106 are configured so as to precisely maintain the RF circuit package 202 in a position within the waveguide interface assembly 102 such that the internal opening of the waveguide channel 114 aligns with either the probe element 314 and the waveguide opening formed by the open region 308 of the microstrip-to-waveguide transition 222 or the probe element 334 and the waveguide opening formed by the open region 328 of the microstrip-to-waveguide transition 224, depending on the orientation selected for the upper assembly 104.

Figure 13:
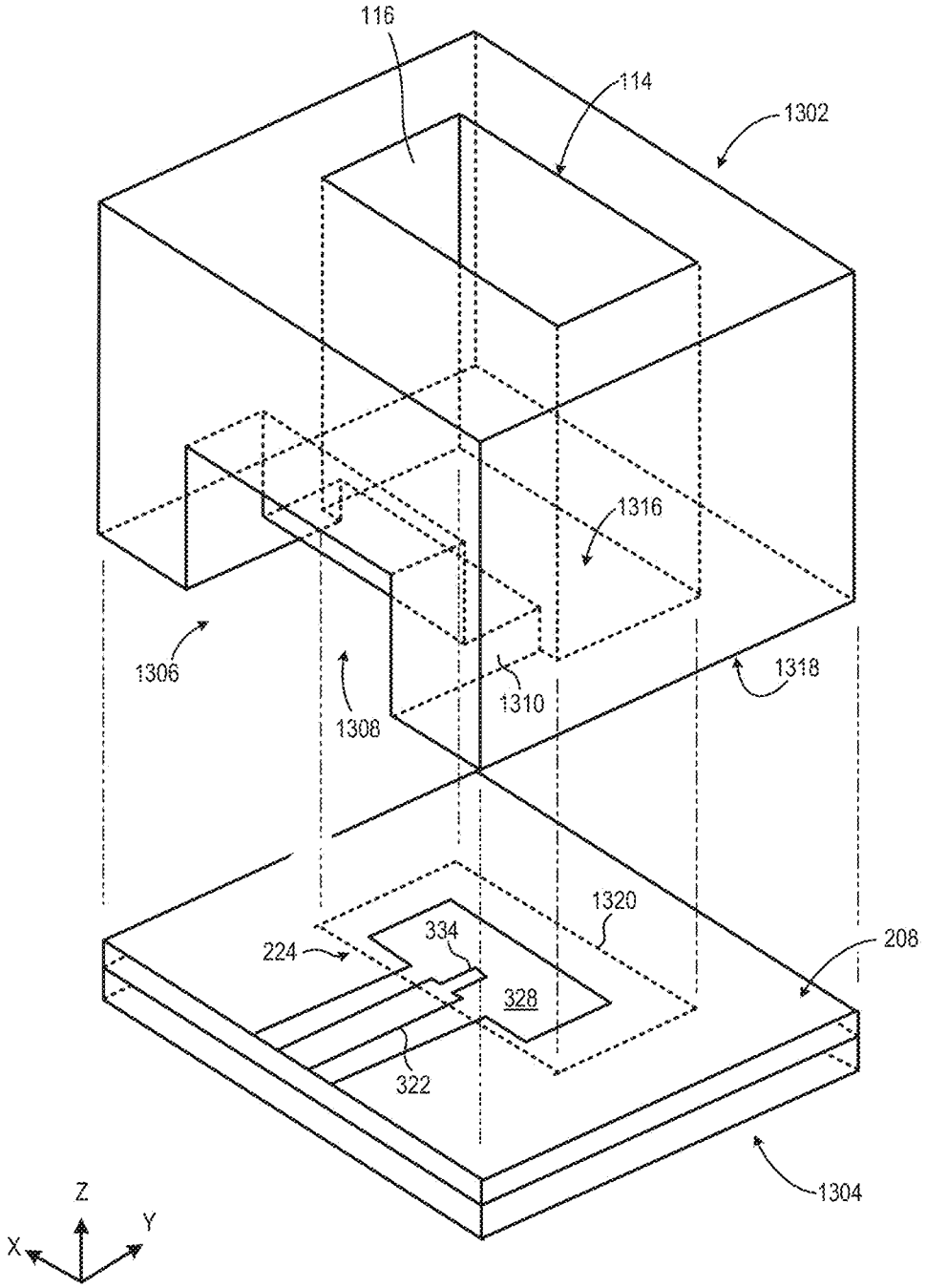
FIG. 13 is an exploded perspective view of a portion of the upper assembly of FIG. 14 and a corresponding portion of an RF circuit package in accordance with some embodiments of the present disclosure.

FIG. 13 illustrates this alignment using a perspective exploded view of a portion 1302 of the upper assembly 104 that includes the waveguide channel 114 relative to a corresponding portion 1304 of the substrate 206 including the microstrip-to-waveguide transition 224. As illustrated by the portion 1302, the upper assembly 104 includes an upper cavity 1306 including a die cavity portion 1308 to accommodate the IC die 204 (FIG. 2) and a transition cavity portion 1310 to maintain the metal of the upper assembly 104 at sufficient distance from the microstrip element 332 of the microstrip feedline 322 to reduce interference. The transition cavity portion 1310 leads into the waveguide channel 114, which has the external opening 116 at the external surface 112 and an opening 1316 at an internal surface 1318 of the upper assembly 104 which forms a portion of the surface of the internal cavity of the waveguide interface assembly 102 (FIG. 1). In other embodiments, the IC die 204 is disposed at the bottom surface 210 of the substrate 206 (FIG. 2), in which instance the die cavity portion 1308 instead may be formed in the lower assembly 106 (FIG. 1).

Portion 1304 illustrates the microstrip feedline 302 and the open region 308 surrounding the probe element of the microstrip feedline 302. The metal vias 306 (FIG. 3) forming the perimeter of the open region 328 are omitted from the view of FIG. 13 for clarity. The waveguide channel 114 is aligned with the open region 328 in that the interior opening 1316 of the waveguide channel 114 overlies and extends over open region 328 in the X-Y plane when the RF circuit package 202 is inserted into the internal cavity and abutting the upper assembly 104 in the 0° orientation. Outline 1320 illustrates the position and extent of internal opening 1316 of the waveguide channel 114 relative to the open region 328 when the internal surface 1318 of the upper assembly 104 and the abuts the top surface 208 of the substrate 206 of the RC circuit package 202.

Figure 14:
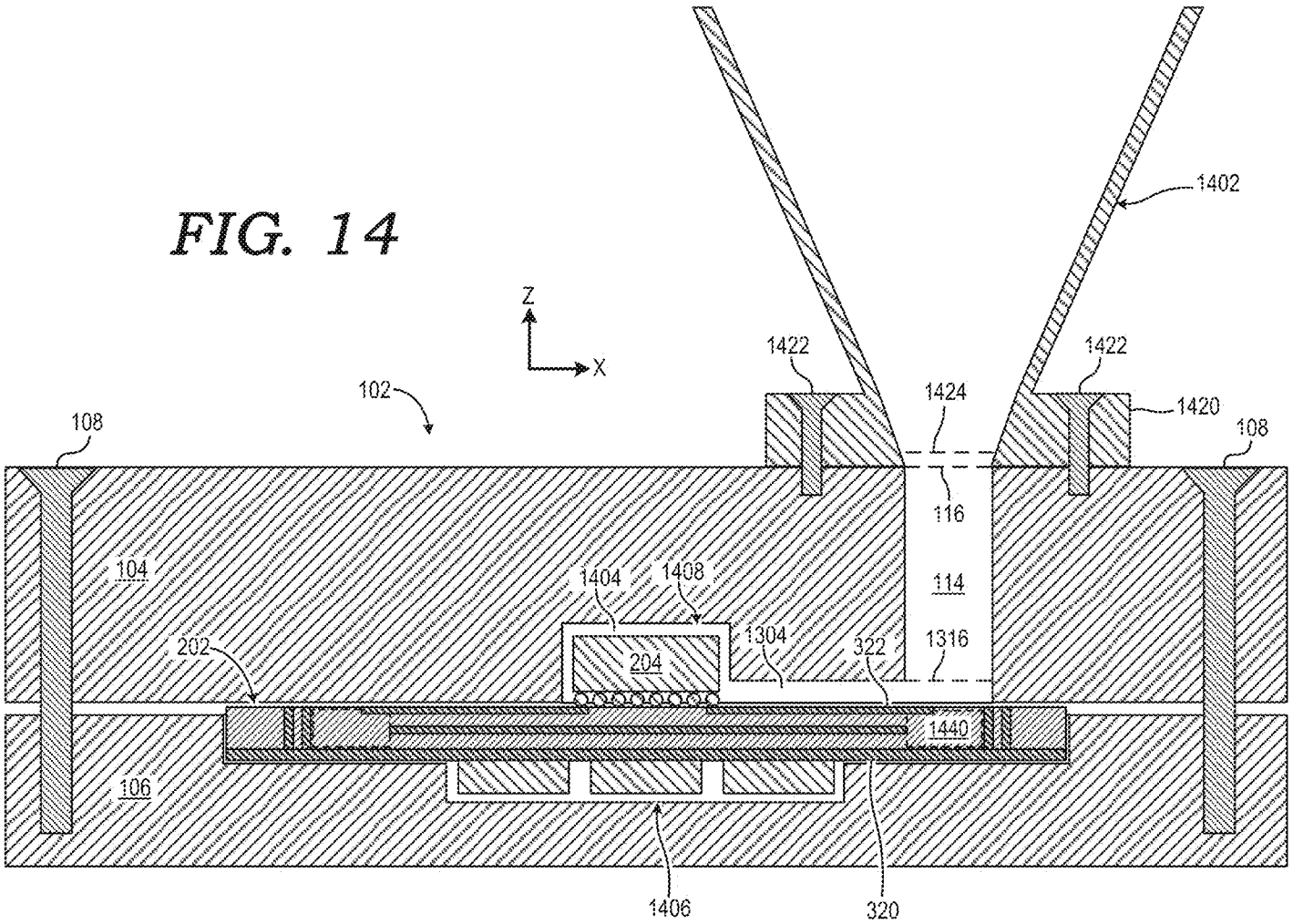
FIG. 14 is a cross-sectional view of a waveguide interface assembly in accordance with some embodiments of the present disclosure.

FIG. 14 illustrates a cross-sectional view along line A-A (shown in FIGS. 11 and 12) of an example implementation of the waveguide interface assembly 102 with an attached horn antenna 1402. The upper assembly 104 and lower assembly 106 are fastened together via machine bolts 108 to form the waveguide interface assembly 102. Although the machine bolts 108 are not incident to the line A-A, their representations are included in the cross-sectional view for purposes of illustration. In the depicted example, the upper assembly 104 is arranged in the 0° orientation.

An upper cavity 1404 (one example of the upper cavity 1306 of FIG. 13) formed in the bottom surface of the upper assembly 104 and a lower cavity 1406 formed in the top surface of the lower assembly 106 together define an internal cavity 1408 in which the RC circuit package 202 is disposed. The lower cavity 1406 is dimensioned and positioned to accommodate the substrate 206 and the components disposed at the bottom surface 210 of the substrate 206, such as a crystal oscillator, the cable connector 212 (FIG. 2), and the like. The upper cavity 1404 is positioned and dimensioned to accommodate components disposed at the top surface 208 of the substrate 206, including the IC die 204 using the die cavity portion 1308. The upper cavity 1404 further includes the transition cavity portion 1310, which abuts the waveguide channel 114.

In the illustrated 0° orientation of the upper assembly 104, the transition cavity portion 1310 is aligned with the microstrip element 332 (FIG. 3) of the microstrip feedline 322, and the internal opening 1316 of the waveguide channel 114 is aligned with the probe element 334 and the open region 328 of the microstrip-to-waveguide transition 224. Thus, in this orientation, the ground plane 320, the wall 324 of vias 306 (FIG. 3), the open region 328, and the dielectric cavity 1440 between the ground plane 320 and the probe element 334 (see, e.g., dielectric cavity 340, FIG. 3) together effectively form a proximate section of a waveguide and an insertion point for the probe element 334. The waveguide channel 114, having the internal opening 1316 aligned with the open region 328 in the illustrated orientation, forms the distal section of the resulting waveguide.

The horn antenna 1402 includes a waveguide flange 1420 attached to the waveguide flange interface 110 (FIG. 1) via, for example, bolts 1422. The waveguide flange 1420 includes an opening 1424 aligned with the external opening 116 of the waveguide channel 114. Thus, in an implementation of this configuration as a transmit configuration, the IC die 204 receives data from a signal processing device via the cable interconnect 122 (FIG. 1), converts this data to corresponding RF signaling, and excites the probe element 334 via the RF signaling to generate corresponding EM signaling. This EM signaling is guided via the proximate waveguide section into the waveguide channel 114, which then guides the EM signaling to the horn antenna 1402. The horn antenna 1402 focuses the open-air propagation of the EM signaling in the direction in which the horn antenna 1402 is aimed. Conversely, in an implementation of this configuration as a receive configuration, EM signaling is gathered by the horn antenna 1402 and focused into the waveguide channel 114. The waveguide channel 114 guides the EM signaling to the probe element 334, which results in RF signaling being generated on the microstrip feedline 322. The IC die 204 senses this RF signaling and converts it to the corresponding digital signal, which is then provided to an external signal processing device via the cable interconnect 122.

Figure 15:
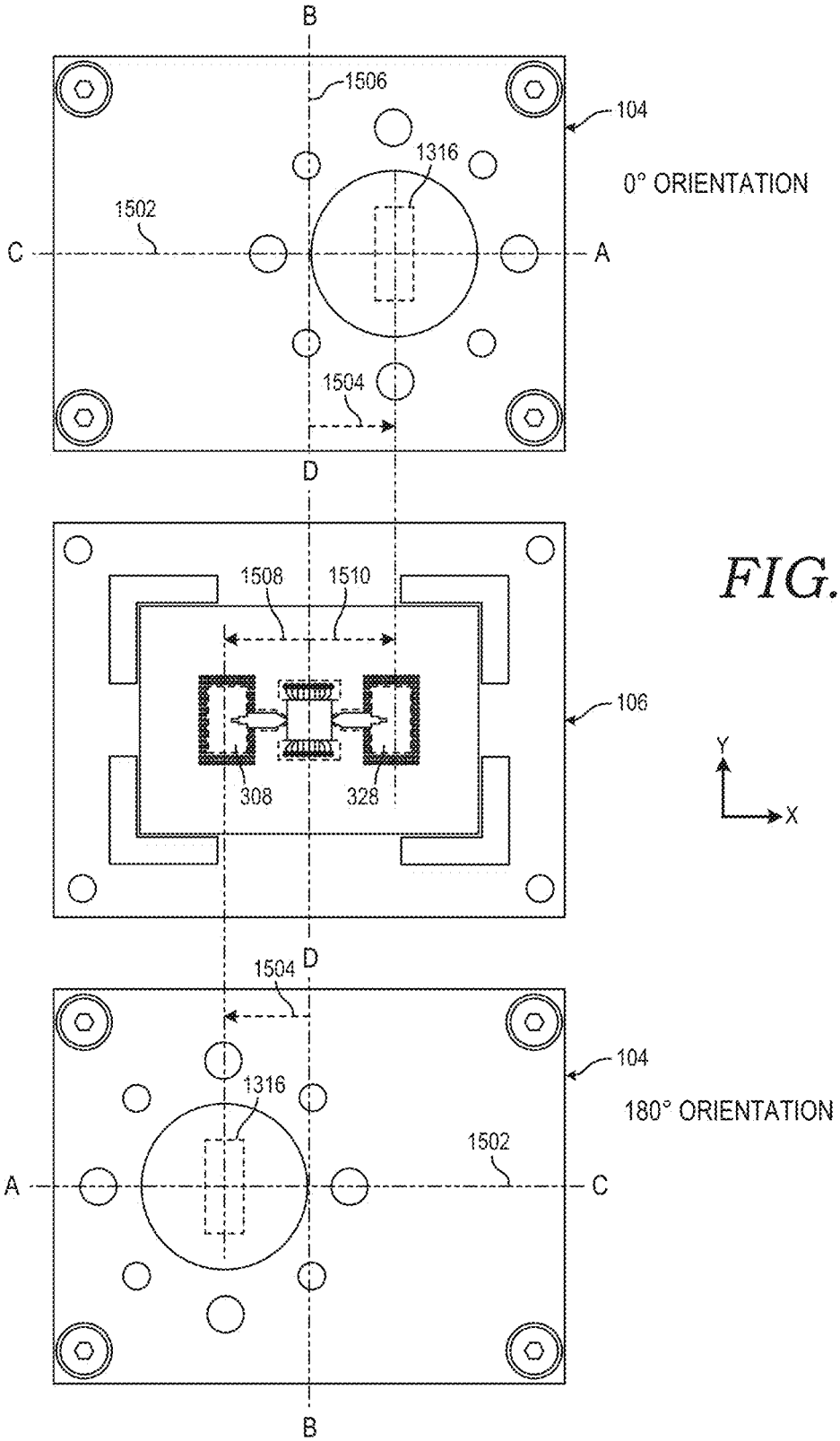
FIG. 15 is a top view diagram illustrating dual symmetric orientations of the upper assembly of a waveguide interface assembly in accordance with some embodiments of the present disclosure.
Figure 16:
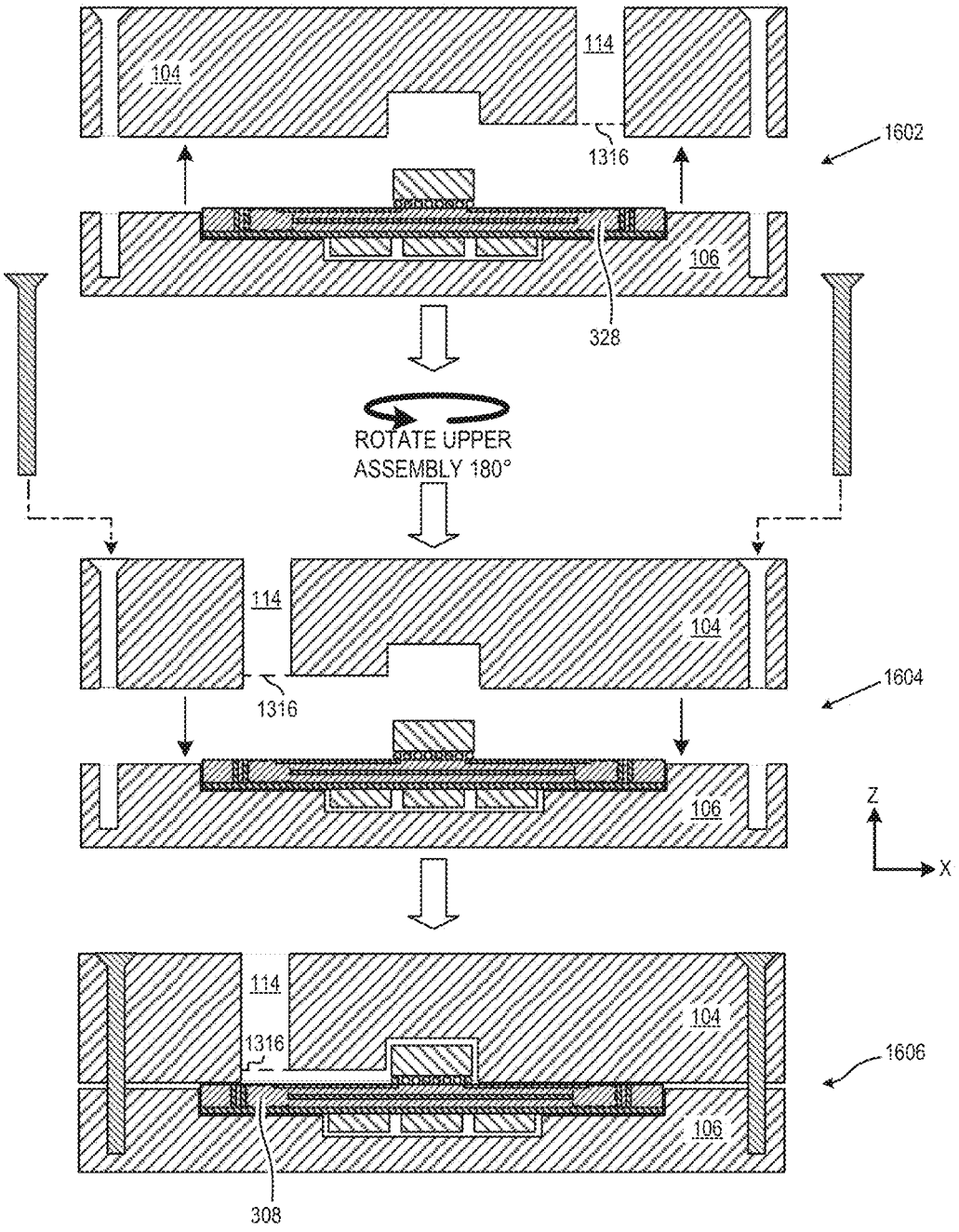
FIG. 16 is a cross-sectional view diagram illustrating the dual symmetric orientations of the upper assembly of FIG. 15 in accordance with some embodiments of the present disclosure.

FIGS. 15 and 16 illustrate implementation the dual-mode configurability of the microwave antenna device 100 in greater detail. FIG. 15 illustrates top views of the upper assembly 104 relative to the lower assembly 106 in the 0° orientation and the 180° orientation. As illustrated by the top view of the upper assembly 104 in the 0° orientation, the upper assembly 104 may be formed so that the internal opening 1316 (see, e.g., FIG. 14) of the waveguide channel 114 is centered about the X-axis centerline 1502 of the upper assembly 104 and is offset by an offset distance 1504 from the Y-axis centerline 1506 of the upper assembly 104. Correspondingly, the RF circuit package 202 may be configured so that, when disposed in the appropriate mounting location in the lower assembly 105, the open region 308 of the microstrip-to-waveguide transition 222 and the open region 328 of the microstrip-to-waveguide transition 224 are offset in opposite directions from this same centerline location by offset distances 1508 and 1510, respectively, which are substantially equal to the offset distance 1504.

FIG. 16 illustrates cross-sectional views of the waveguide interface device 102 along line A-A (see FIGS. 11 and 12) with respect to the centered-and-offset configuration of upper assembly 104 in the 0° orientation and the 180° orientation depicted in FIG. 15. As illustrated by cross-sectional view 1602, when the upper assembly 104 is in the 0° orientation, the internal opening 1316 of the waveguide channel 114 aligns with the open region 328, and thus the microstrip-to-waveguide transition 224 (FIG. 3) and the waveguide channel 114 together effectively form a waveguide relative to the probe element 334 (FIG. 3). Moreover, with this centered and offset configuration, when the upper assembly 104 is rotated 180° about the Z-axis (as illustrated by cross-sectional view 1604) and then reassembled to the 180° orientation (as illustrated by cross-sectional view 1606), the internal opening 1316 of the waveguide channel 114 then aligns with the open region 308, and thus the microstrip-to-waveguide transition 222 and the waveguide channel 114 together effectively form a waveguide relative to the probe element 314. Thus, if one of the microstrip-to-waveguide transitions 222 and 224 is configured for transmit operation and the other is configured for receive operation, the microwave antenna device 100 can be readily reconfigured between a transmit configuration and a receive operation by rotating the upper assembly 104 between the 0° orientation and the 180° orientation.

Figure 17:
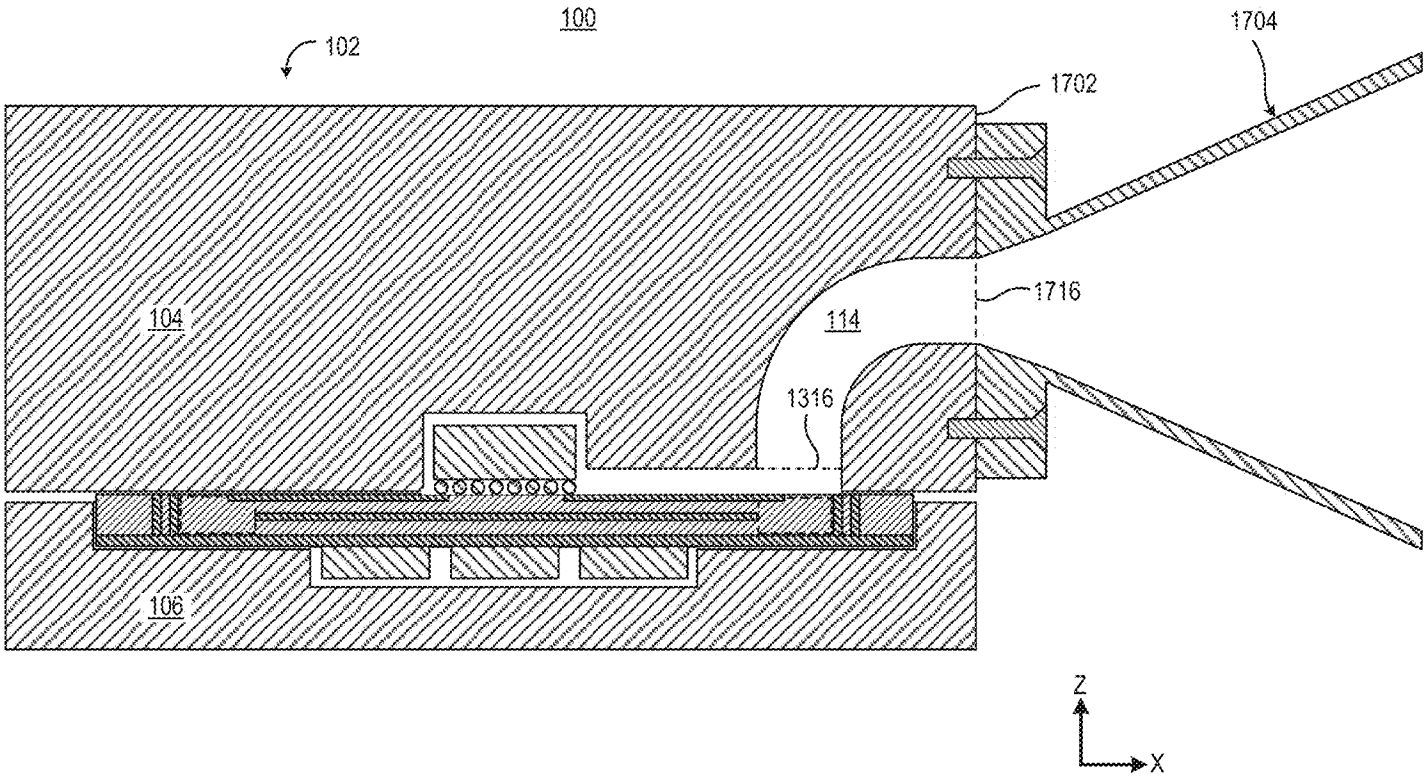
FIG. 17 is a cross-sectional view of an alternative implementation of a waveguide interface assembly with a side-mount waveguide interface in accordance with some embodiments of the present disclosure.

FIG. 17 illustrates cross-sectional view of an alternative implementation of the waveguide interface assembly 102 of the microwave antenna device 100 along line A-A (see FIGS. 11 and 12). In this implementation, the waveguide flange interface 110 (FIG. 1) is disposed at a side external surface 1702 of the upper assembly 104 such that a horn antenna 1704 or other external waveguide device attached to the waveguide flange interface 110 is oriented in the X-axis, rather than the Z-axis orientation illustrated in prior figures. In such an implementation, the waveguide channel 114 extends along a curved or bent path such that an external opening 1716 of the waveguide channel 114 at the side external surface 1702 is perpendicular or otherwise non-parallel to the internal opening of the waveguide channel 114. However, in this configuration, the internal opening 1316 may maintain its centered-and-offset position relative to the centerlines 1502 and 1506 (FIG. 15) so as to facilitate the dual-mode operation described above.

Figure 18:
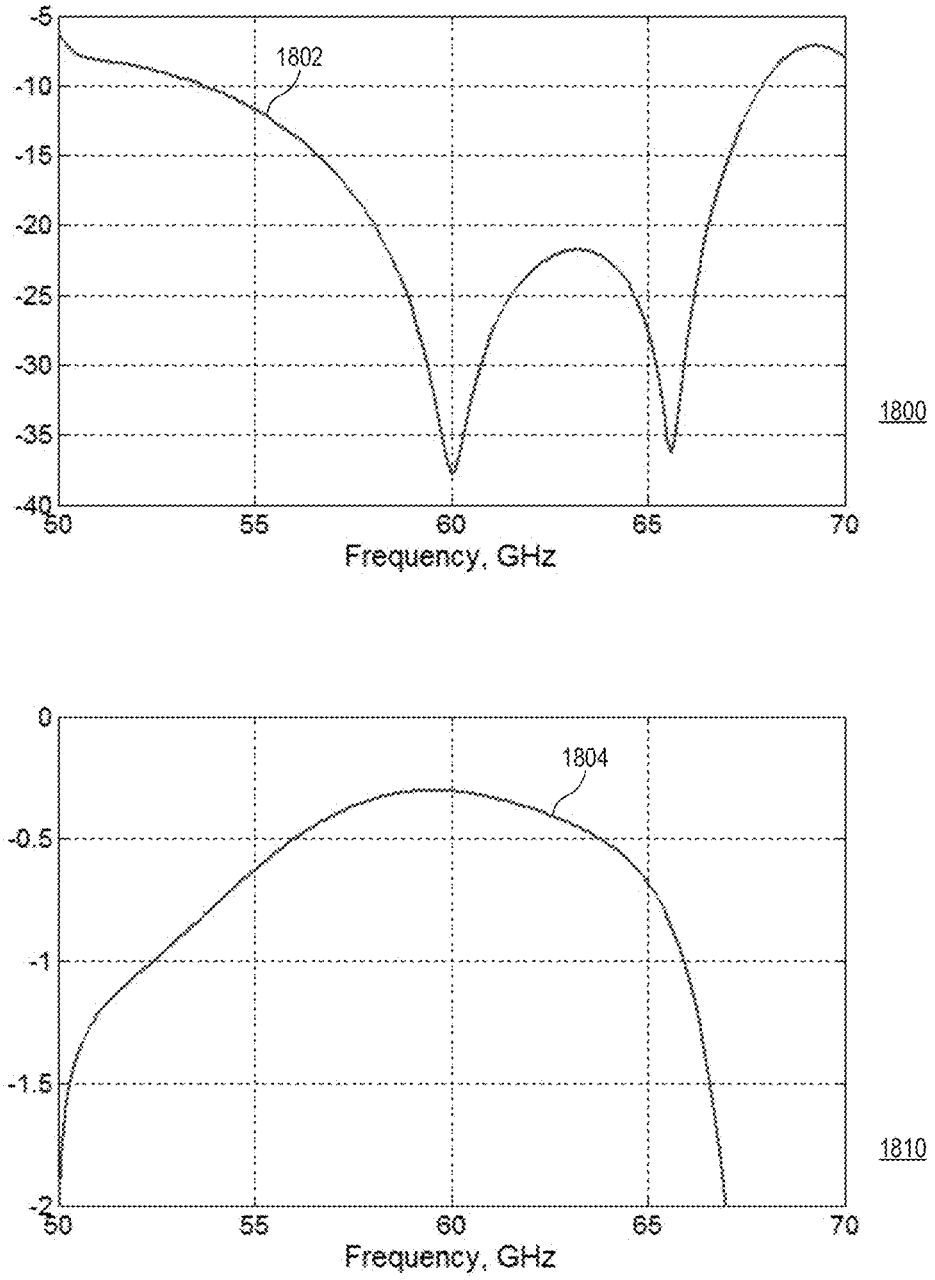
FIG. 18 is a chart illustrating measured operational performance parameters of a microwave antenna device in accordance with some embodiments of the present disclosure.

FIG. 18 illustrates charts 1800 and 1810 illustrating S-parameters simulated in a test implementation of the microwave antenna device 100 fabricated for 60 GHz signaling in accordance with the teachings and specifications described above. Line 1802 of chart 1800 illustrates the measured Si 1 parameter (that is, the return loss parameter) over a frequency spectrum from 54 GHz to 68 GHz. As the return loss is −10 dB or less from approximately 54 GHz to approximately 68 GHz, the test implementation exhibits an absolute bandwidth of 14 GHz around the 60 GHz center frequency, which represents a percentage bandwidth of 23%. Line 1804 of chart 1810 illustrates the measured S21 parameter (that is, the insertion loss parameter). As line 1804 illustrates, the test implementation exhibits an insertion loss as low as 0.25 dB.

In this document, relational terms such as first and second, and the like, may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element. The term "another", as used herein, is defined as at least a second or more. The terms "including" and/or "having", as used herein, are defined as comprising. The term "coupled", as used herein with reference to electro-optical technology, is defined as connected, although not necessarily directly, and not necessarily mechanically.

The specification and drawings should be considered as examples only, and the scope of the disclosure is accordingly intended to be limited only by the following claims and equivalents thereof. Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. An antenna apparatus comprising:

a metal lower assembly and a metal upper assembly, the lower and upper assemblies together forming a cavity to contain a radio frequency (RF) circuit device;

the upper assembly comprising a waveguide flange interface disposed at an external surface of the upper assembly, the waveguide flange interface comprising a waveguide channel extending from the external surface to an internal surface that forms a surface of the cavity, an internal opening of the waveguide channel at the internal surface being substantially centered with a first centerline of the upper assembly parallel with the external surface and offset from a second centerline of the upper assembly parallel with the external surface, the second centerline perpendicular to the first centerline, wherein the upper assembly is removably attachable to the lower assembly in either of a first orientation or a second orientation relative to the lower assembly, the second orientation representing a 180 degree rotation of the upper assembly relative to the first orientation; and the RF circuit device disposed in the cavity, the RF circuit device comprising:

a substrate comprising a first microstrip feedline and a second microstrip feedline disposed at a first metal layer, the first microstrip feedline having a first probe element at a first region of the first metal layer, and the second microstrip feedline having a second probe element at a second region of the first metal layer;

wherein the internal opening of the waveguide channel is aligned with the first region when the upper assembly is attached to the lower assembly in the first orientation; and wherein the internal opening of the waveguide channel is aliened with the second region when the upper assembly is attached to the lower assembly in the second orientation.

2. The antenna apparatus of claim 1, further comprising:

an integrated circuit (IC) die disposed at a surface of the substrate, the IC die comprising RF circuitry configured to transmit RF signaling via the first probe element and configured to receive RF signaling via the second probe element.

3. The antenna apparatus of claim 1, wherein:

the RF circuit device is configured to communicate signaling;

the substrate further comprises:

a second metal layer comprising a ground plane; and a dielectric layer disposed between the first and second metal layer; and wherein the substrate has a total thickness approximately equal to a wavelength of a center frequency of a bandwidth of the signaling.

4. The antenna apparatus of claim 3, wherein the center frequency is between 55 and 65 gigahertz and the total thickness of the substrate is approximately 850 micrometers.

5. The antenna apparatus of claim 1, wherein the substrate further comprises:

a first plurality of metal vias disposed at the perimeter of the first region surrounding the first probe element and extending from the first metal layer to a second metal layer, and the first region being substantially devoid of conductive material; and a second plurality of metal vias disposed at the perimeter of the second region surrounding the second probe element and extending from the first metal layer to the second metal layer, and the second region being substantially devoice of conductive material.

6. The antenna apparatus of claim 1, wherein the external surface is parallel to the internal surface.

7. The antenna apparatus of claim 1, wherein the external surface is perpendicular to the internal surface.

8. The antenna apparatus of claim 1, wherein the waveguide flange interface is compatible with an Electronic Industries Alliance (EIA) WR flange specification.

9. The antenna apparatus of claim 1, further comprising:

an antenna comprising a waveguide flange attached to the waveguide flange interface.

10. The antenna apparatus of claim 1, further comprising:

a first plurality of bolt holes extending through the upper assembly; and a second plurality of bolt holes extending into the lower assembly; and wherein each of the first plurality of bolt holes is aligned with a bolt hole of the second plurality of bolt holes whether the upper assembly is positioned in the first orientation or the second orientation.

11. The antenna apparatus of claim 1, further comprising:

a wiring connector aperture extending from an external surface of the lower assembly to the cavity.

12. A method of communicating radio frequency (RF) signaling, the method comprising:

providing an RF circuit device having a first microstrip feedline with a first probe element at a first region of a substrate of the RF device and a second microstrip feedline with a second probe element at a second region of the substrate;

providing a waveguide interface assembly comprising a metal lower assembly and a metal upper assembly, the lower and upper assemblies together forming a cavity to contain the RF circuit device, and the upper assembly comprising a waveguide flange interface comprising a waveguide channel extending from an external surface of the upper assembly to an internal surface forming a surface of the cavity, an internal opening of the waveguide channel at the internal surface being substantially centered with a first centerline of the upper assembly parallel with the external surface and offset from a second centerline of the upper assembly parallel with the external surface, the second centerline perpendicular to the first centerline;

removably attaching the upper assembly in either of a first orientation or a second orientation relative to the lower assembly, wherein in the first orientation the internal opening of the waveguide channel is aligned with the first region and in the second orientation the internal opening of the waveguide channel is aligned with the second region; and communicating RF signaling using the RF circuit device and the waveguide interface assembly.

13. The method of claim 12, wherein the second orientation represents a 180 degree rotation of the upper assembly relative to the first orientation.

14. The method of claim 12, wherein:

removably attaching the upper assembly comprises removably attaching the upper assembly in the first orientation; and communicating RF signaling comprises transmitting RF signaling using the first microstrip feedline and the waveguide interface assembly with the upper assembly in the first orientation.

15. The method of claim 14, further comprising:

reorienting the upper assembly to the second orientation; and receiving RF signaling using the second microstrip feedline and the waveguide interface assembly with the upper assembly in the second orientation.

16. The method of claim 12, wherein:

removably attaching the upper assembly comprises removably attaching the upper assembly in the second orientation; and communicating RF signaling comprises receiving RF signaling using the second microstrip feedline and the waveguide interface assembly with the upper assembly in the second orientation.

17. A method of manufacturing a waveguide interface assembly, the method comprising:

fabricating a metal lower assembly and a metal upper assembly, the lower and upper assemblies together forming a cavity to contain a radio frequency (RF) circuit device;

fabricating, at the upper assembly, a waveguide flange interface disposed at an external surface of the upper assembly, the waveguide flange interface comprising a waveguide channel extending from the external surface to an internal surface forming a surface of the cavity, an internal opening of the waveguide channel at the internal surface being substantially centered with a first centerline of the upper assembly parallel with the external surface and offset from a second centerline of the upper assembly parallel with the external surface, the second centerline perpendicular to the first centerline; and wherein the upper assembly is removably attachable to the lower assembly in either of a first orientation or a second orientation relative to the lower assembly, the second orientation representing a 180 degree rotation of the upper assembly relative to the first orientation.

18. The method of claim 17, further comprising:

fabricating a first plurality of bolt holes extending through the upper assembly; and fabricating a second plurality of bolt holes extending into the lower assembly; and wherein each of the first plurality of bolt holes is aligned with a bolt hole of the second plurality of bolt holes whether the upper assembly is positioned in the first orientation or the second orientation.

19. The method of claim 17, further comprising:

fabricating a wiring connector aperture extending from an external surface of the lower assembly to the cavity.

* * * * *